US012612228B2

(12) United States Patent
Gift et al.

(10) Patent No.: US 12,612,228 B2
(45) Date of Patent: Apr. 28, 2026

(54) CLOSURE

(71) Applicant: Berry Global, Inc., Evansville, IN (US)

(72) Inventors: Steven Gift, Lititz, PA (US); Benson P. Weaver, Lititz, PA (US); Frank A. Bond, York, PA (US); John A Vassallo, Lititz, PA (US)

(73) Assignee: Berry Global, Inc., Evansville, IN (US)

( * ) Notice: Subject to any disclaimer, the term of this patent is extended or adjusted under 35 U.S.C. 154(b) by 46 days.

(21) Appl. No.: 18/419,963

(22) Filed: Jan. 23, 2024

(65) Prior Publication Data

US 2024/0253875 A1 Aug. 1, 2024

Related U.S. Application Data

(60) Provisional application No. 63/442,252, filed on Jan. 31, 2023.

(51) Int. Cl.

| | |
|---|---|
| ***B65D 55/14*** | (2006.01) |
| ***B65D 39/08*** | (2006.01) |
| ***B65D 41/04*** | (2006.01) |
| ***B65D 41/08*** | (2006.01) |
| ***B65D 55/02*** | (2006.01) |

(52) U.S. Cl.

CPC ..... *B65D 55/14* (2013.01); *B65D 41/0478* (2013.01); *B65D 41/08* (2013.01); *B65D 55/028* (2013.01); *B65D 39/08* (2013.01); *B65D 2215/04* (2013.01); *B65D 2555/02* (2013.01)

(58) Field of Classification Search

CPC ..... B65D 55/00; B65D 55/14; B65D 55/028; B65D 41/00; B65D 41/0471; B65D 41/0478; B65D 41/08; B65D 41/083; B65D 41/086; B65D 2215/00; B65D 2215/02; B65D 2215/04; B65D 2555/00; B65D 2555/02; B65D 39/00; B65D 39/08; B65D 39/082; B65D 39/084; B65D 39/086; B65D 39/088

USPC ..... 70/163

See application file for complete search history.

(56) References Cited

U.S. PATENT DOCUMENTS

| | | | | |
|---|---|---|---|---|
| 8,870,030 | B2 * | 10/2014 | Demarest | B65D 83/164 279/81 |
| 8,985,398 | B2 * | 3/2015 | Demarest | B65D 83/262 279/81 |
| 10,961,024 | B2 * | 3/2021 | Gift | B29C 37/0085 |
| 11,116,693 | B2 * | 9/2021 | Gift | B65D 50/041 |
| 2017/0281467 | A1 * | 10/2017 | Solotoff | A61J 1/1437 |
| 2018/0243172 | A1 * | 8/2018 | Zonana | B65D 45/18 |
| 2018/0319555 | A1 * | 11/2018 | Sprick | B65D 41/0414 |

(Continued)

FOREIGN PATENT DOCUMENTS

| | | | | |
|---|---|---|---|---|
| EP | 1724204 | A1 * | 11/2006 | B65D 50/041 |

OTHER PUBLICATIONS

International (PCT) Search Report and Written Opinion for PCT Application No. PCT/EP2024/052008 dated Jul. 8, 2024, 21 pages.

*Primary Examiner* — Nathan Cumar

(74) *Attorney, Agent, or Firm* — Barnes & Thornburg LLP

(57) ABSTRACT

A package comprises a container and a closure. The container includes a body formed to include a product-receiving space, a filler neck coupled to the body, and a thread coupled to the filler neck. The closure includes an outer cap, an inner cap arranged radially inward of the outer cap, and an electronic system arranged between the outer cap and the inner cap.

16 Claims, 11 Drawing Sheets

(56) References Cited

U.S. PATENT DOCUMENTS

| | | | | |
|---|---|---|---|---|
| 2020/0339317 | A1* | 10/2020 | French | B65D 1/0246 |
| 2020/0390656 | A1* | 12/2020 | Aertker | B65D 50/00 |
| 2021/0179323 | A1* | 6/2021 | Kreinbrink | B65D 50/041 |
| 2021/0347540 | A1* | 11/2021 | Telschow | B05B 11/1059 |
| 2021/0378914 | A1* | 12/2021 | Gift | B65D 50/045 |

* cited by examiner

CLOSURE

PRIORITY CLAIM

This application claims priority under 35 U.S.C. § 119(e) to U.S. Provisional Patent Application No. 63/442,252, filed on Jan. 31, 2023, which is expressly incorporated by reference herein.

BACKGROUND

The present disclosure relates to packages, and particularly to child-resistant packages. More particularly, the present disclosure relates to a child-resistant package including a container and a closure removably coupled to the container.

SUMMARY

A child-resistant package in accordance with the present disclosure includes a container and a closure. In illustrative embodiments, the container is formed to include an interior region to store products therein. The closure includes an outer cap and an inner cap that cooperate to lock and unlock the closure from the container.

In illustrative embodiments, the outer cap of the closure is moveable relative to the inner cap in response to a downward force applied to the outer cap to unlock the closure from the container so the closure can be separated from the container. The closure includes an electronic system that is activated in response to the downward force on the outer cap. The electronic system tracks and stores data related to the downward force applied to the outer cap.

In illustrative embodiments, the electronic system outputs an indicator in response to the activation of the electronic system. The indicator represents whether separation of the closure from the container is timely so that the products within the container are not prematurely removed.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
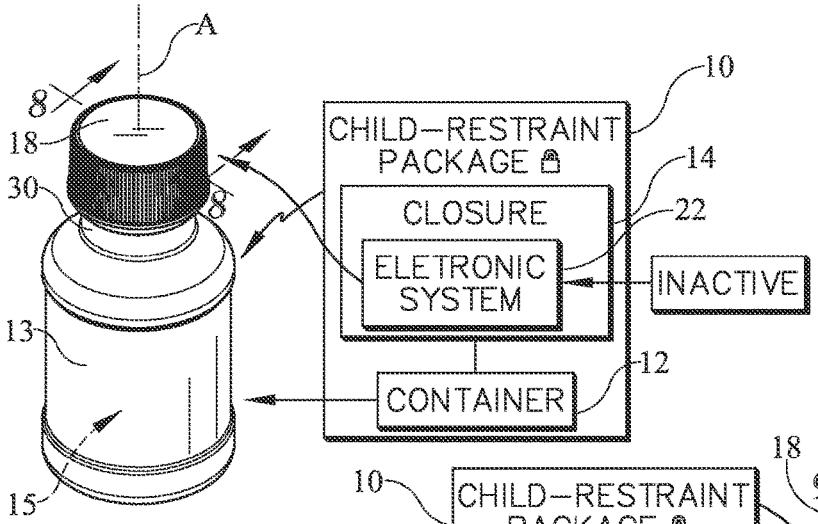
FIG. 1 is a perspective and diagrammatic view of a child-resistant package in a closed configuration, the package including a container and a closure coupled with the container in a locked arrangement so that a product within the container cannot be removed, and further showing that the closure includes an electronic system that is inactive while the package is in the closed configuration and the closure is in the locked arrangement.

A child-resistant package 10 in accordance with the present disclosure is shown in FIGS. 1-4. The child-resistant package 10 includes a container 12 and a closure 14 configured to close selectively an aperture 16 of the container 12 as suggested in FIG. 4. The package 10 includes a body 13 formed to include a product-receiving space 15. Illustratively, the product-receiving space 15 may receive medication therein. A first embodiment of the closure 14 is shown in FIGS. 1-14, and a second embodiment of the closure 214 is shown in FIGS. 15-18.

Figure 5:
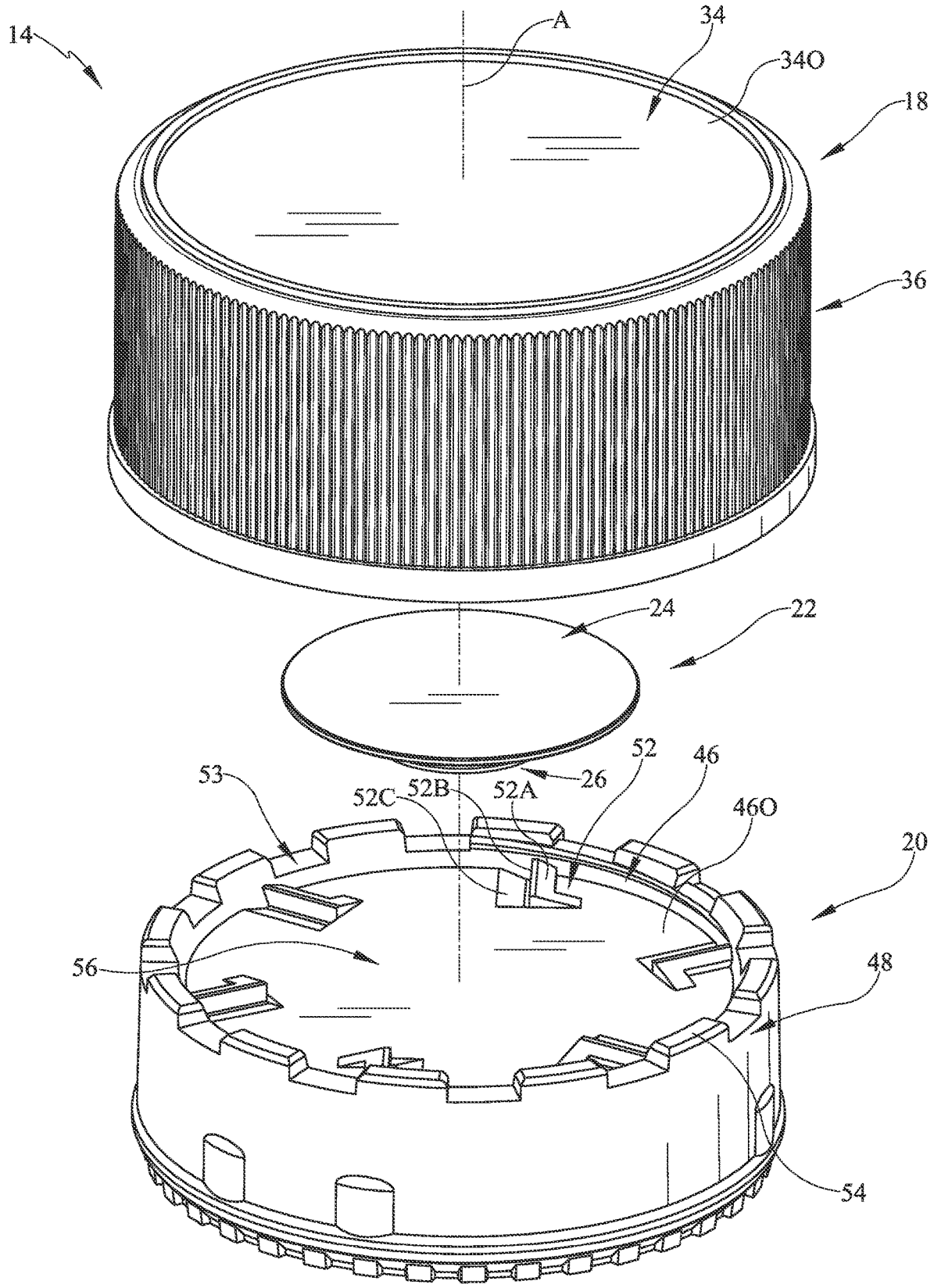
FIG. 5 is a top exploded assembly view of the closure of FIG. 1 showing that the closure includes an outer cap, an inner cap located radially inward of the outer cap relative to the vertical axis, and the electronic system arranged axially between the outer cap and the inner cap.
Figure 6:
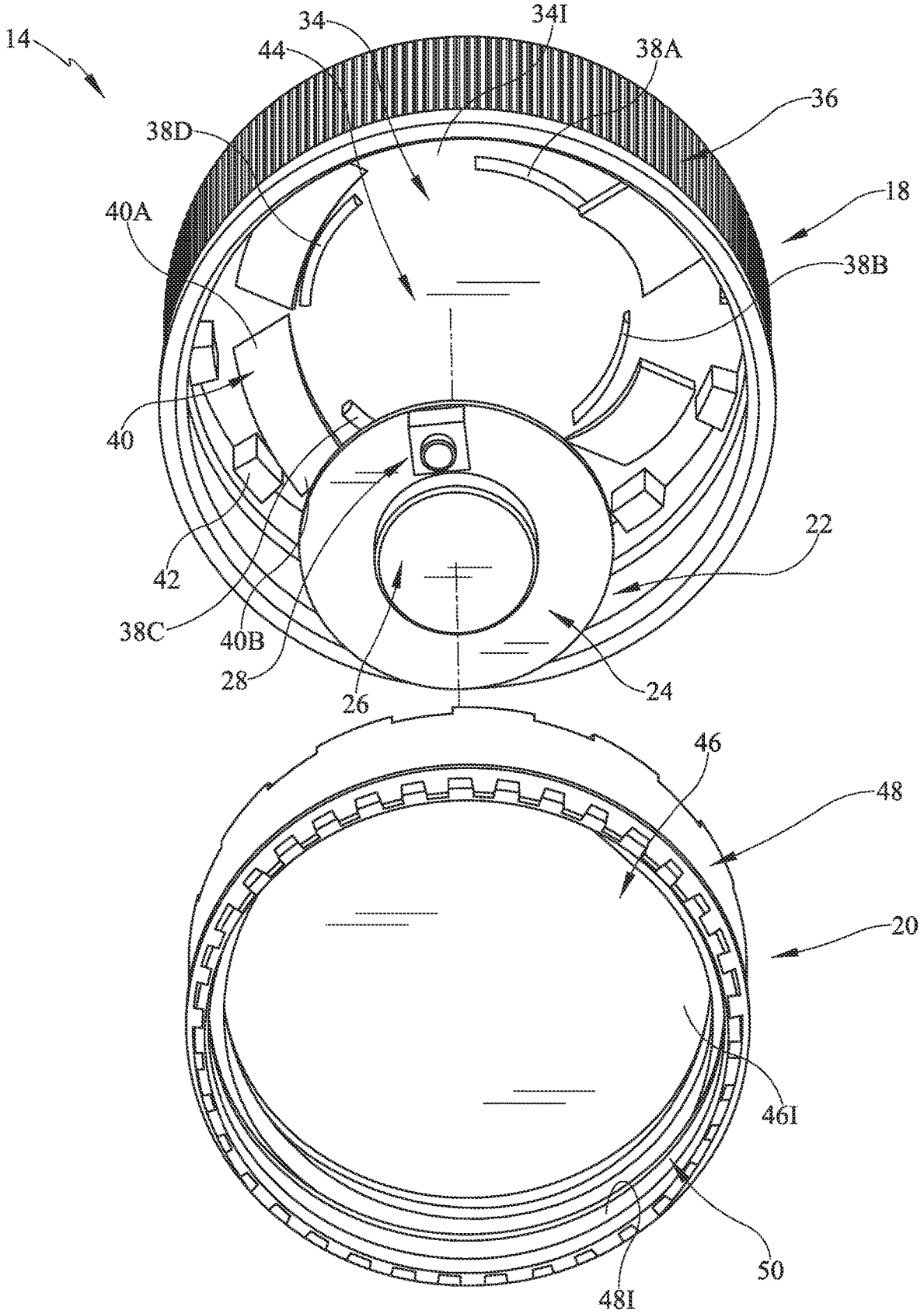
FIG. 6 is a bottom exploded assembly view of the closure of FIG. 1 showing that the electronic system includes a circuit board coupled with the outer cap, a battery coupled with the circuit board and extending downwardly therefrom toward the inner cap, and a switch coupled with the circuit board and extending downwardly therefrom toward the inner cap.

The closure 14 includes an outer cap 18, an inner cap 20, and an electronic system 22 as shown in FIGS. 5 and 6. The inner cap 20 is arranged radially inward of the outer cap 18 relative to a vertical axis A of the closure 14. The electronic system 22 is coupled to the outer cap 18 such that the electronic system 22 is arranged axially between the outer cap 18 and the inner cap 20 relative to the vertical axis A.

Figure 2:
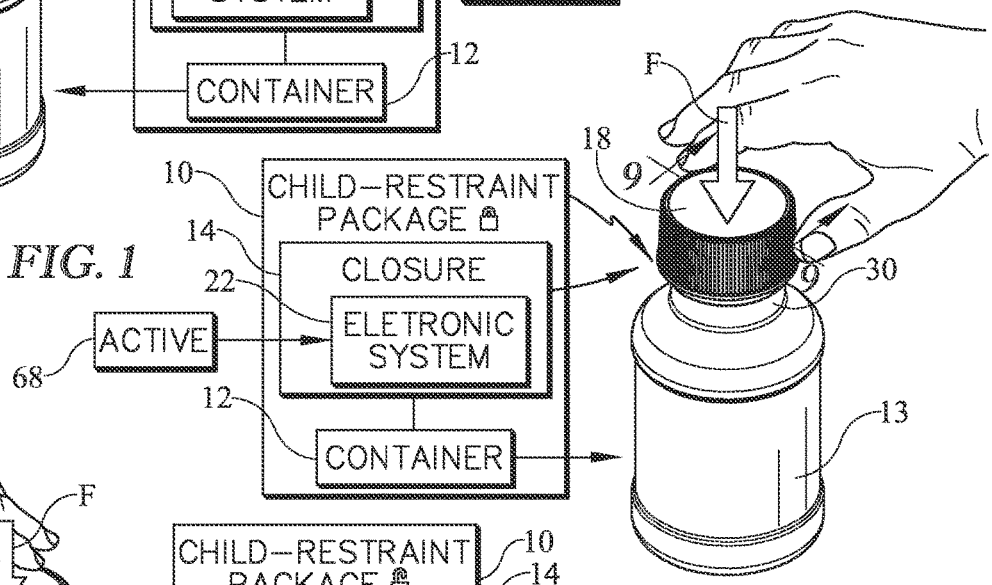
FIG. 2 is a view similar to FIG. 1 showing that a downward force is applied to the closure by a user to activate the electronic system.
Figure 3:
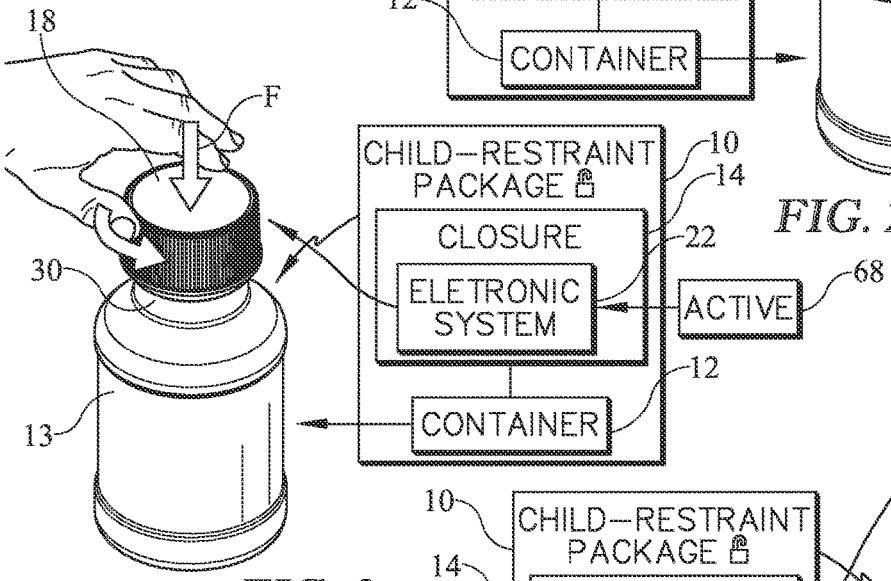
FIG. 3 is a view similar to FIGS. 2 and 3 showing that the downward force is applied to the closure and the closure is rotated about a vertical axis by the user to change the closure from the locked arrangement, as shown in FIGS. 1 and 2, to an unlocked arrangement so that the closure may be separated from the container and the product within the container may be accessed by the user.
Figure 4:
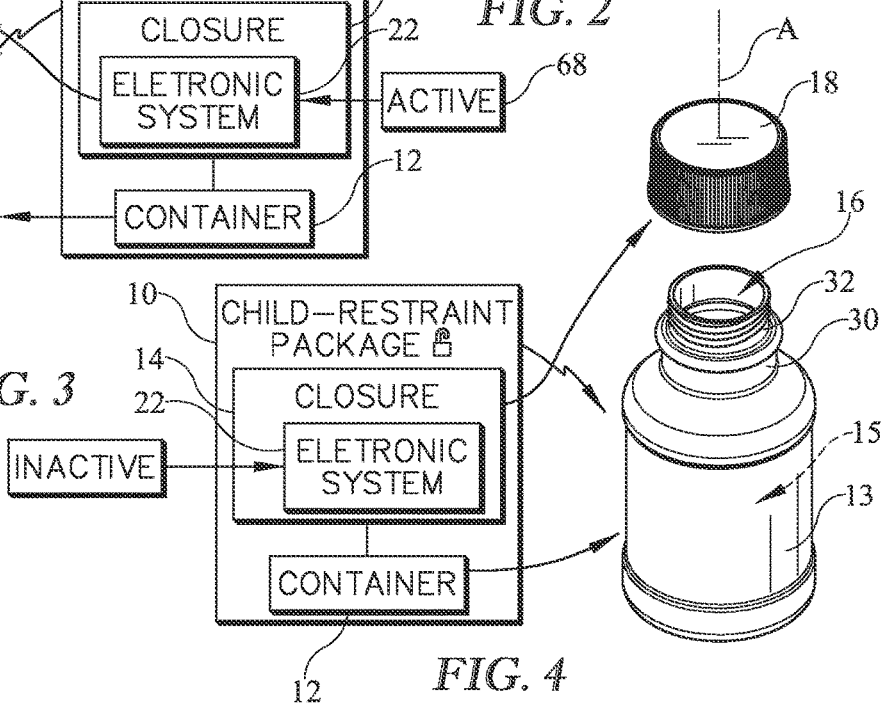
FIG. 4 is a view similar to FIGS. 1-3 showing that the closure is separated from the container after the closure is changed to the unlocked arrangement to change the package to an opened configuration, and further showing that the electronic system of the closure is inactive while the downward force is not applied to the closure by the user.

The package 10 is configured to change between a closed configuration, in which the closure 14 is coupled to the container 12 in a locked arrangement to close the aperture 16 of the container 12, as shown in FIGS. 1 and 2, and an opened configuration, in which the closure is 14 changed to an unlocked arrangement and separated from the container 12 in response to a downward force F and a rotational force on the outer cap 18, as shown in FIGS. 3 and 4. The closure 14 may be pushed downwardly and rotated about the vertical axis A to change between the locked arrangement and the unlocked arrangement so that the package 10 is changed from the closed configuration to the opened configuration. The two-step operation helps provide the child-resistant functionality to the package 10.

Figure 8:
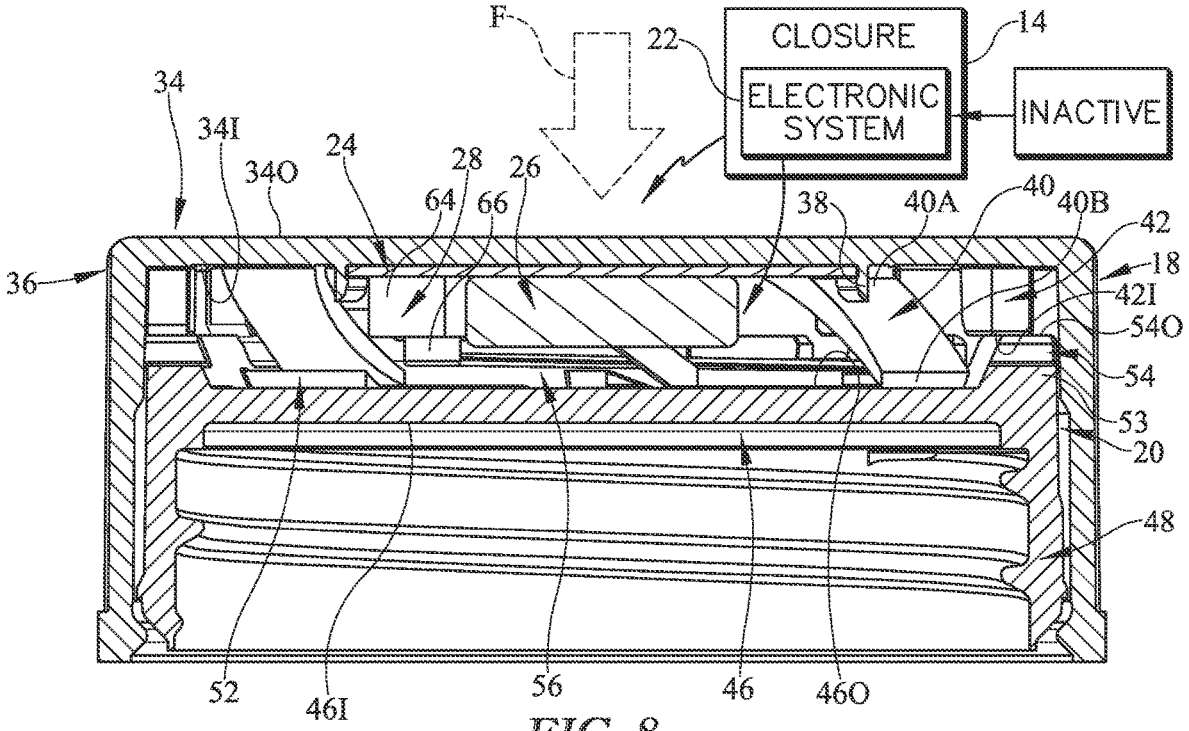
FIG. 8 is a sectional view taken along line 8-8 of FIG. 1 showing the closure without the downward force applied to the outer cap so that the electronic system is inactive, and further showing that the switch is in a first position and spaced apart from the inner cap while the downward force is not applied to the outer cap.
Figure 9:
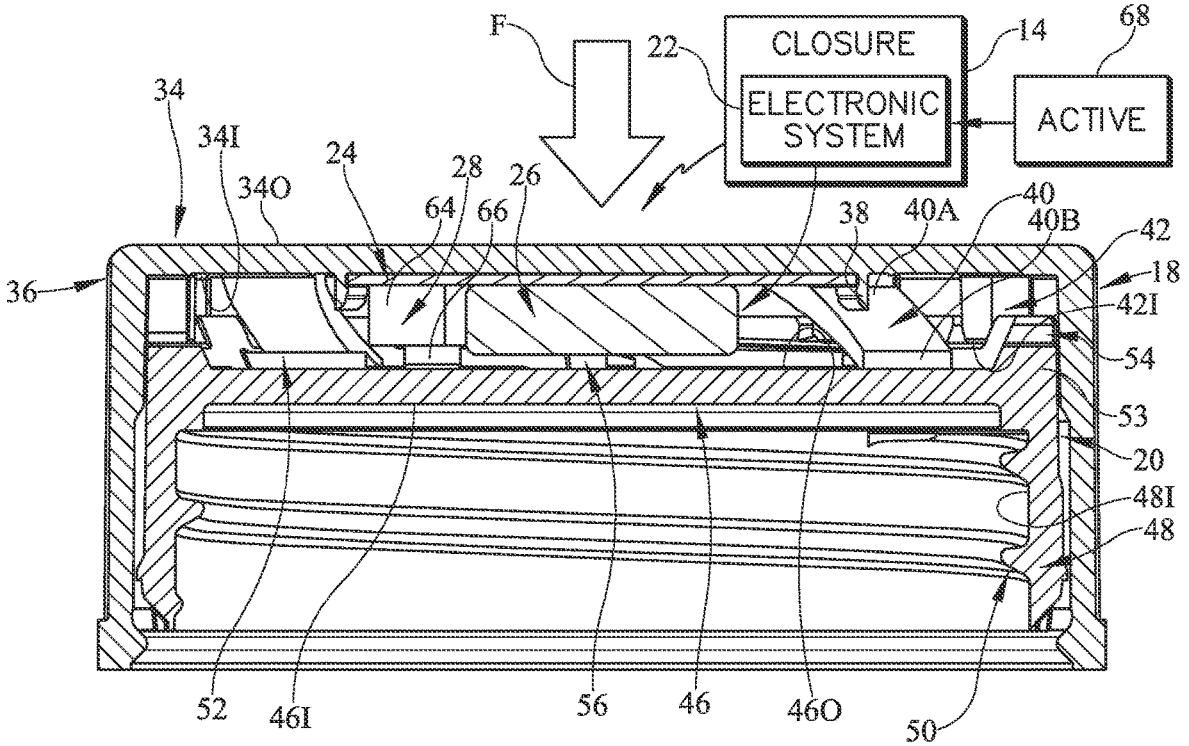
FIG. 9 is a sectional view taken along line 9-9 of FIG. 1 showing the closure with the downward force applied to the outer cap that causes the outer cap to move downwardly toward the inner cap such that the electronic system is active, and further showing that, in response to the downward force, the switch moves to a second position in which the switch directly contacts the inner cap to activate the electronic system.

In response to the downward force F applied to the outer cap 18, the outer cap 18 and the electronic system 22 move downwardly toward the inner cap 20 as shown in FIG. 9. The electronic system 22 includes a circuit board 24, a battery 26 coupled to the circuit board 24, and a switch 28 coupled to the circuit board 24 as shown in FIGS. 6, 8, and 9. The downward force F on the outer cap 18 causes the switch 28 of the electronic system 22 to move from a first position in which the switch 28 is spaced apart from the inner cap 20, as shown in FIG. 8., to a second position in which the switch 28 directly contacts the inner cap 20, as shown in FIG. 9. The electronic system 22 is configured to output an indicator 68 in response to the switch 28 being in the second position as suggested in FIGS. 2 and 3.

Figure 7:
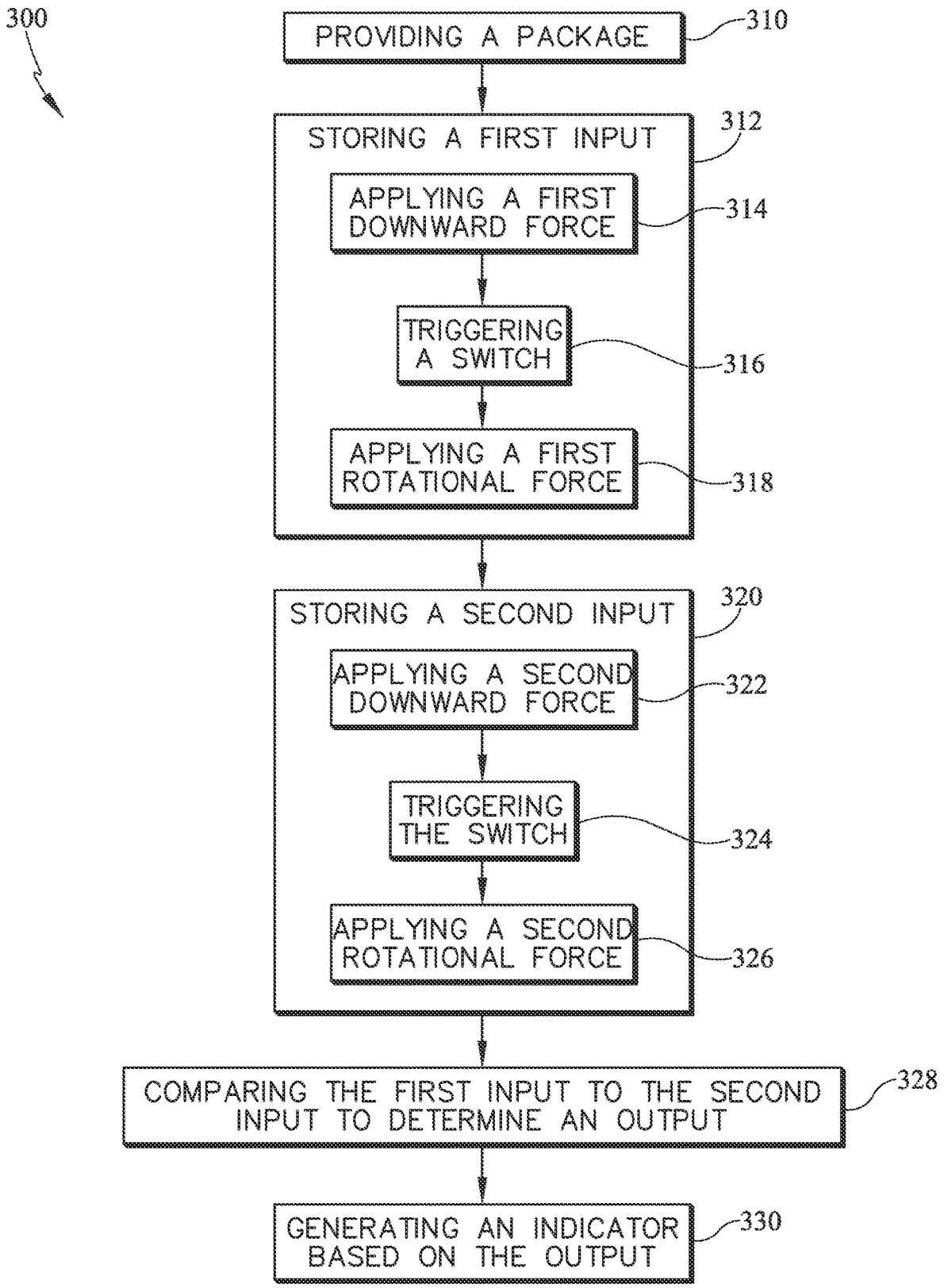
FIG. 7 is a diagrammatic view showing a process of using the closure of FIG. 1.

A method 300 of using the package 10 is shown in FIG. 7. The method 300 includes step 310 of providing the package 10. The package 10 includes the container 12 and the closure 14, 214 selectively coupled with the container 12. The closure 14, 214 includes the outer cap 18, 218, the inner cap 20, 220 coupled to the outer cap 18, 218, and the electronic system 22, 222 located between the outer cap 18, 218 and the inner cap 20, 220. The method 300 includes step 312 of storing a first input. Step 312 includes step 314 of applying a first downward force F to the outer cap 18, 218 that causes the outer cap 18, 218 to move downwardly toward the inner cap 20, 220. Step 312 also includes step 316 of triggering the switch 28, 228 in response to the first downward force F. Step 312 also includes step 318 of applying a first rotational force to the outer cap 18, 218 so that the closure 14, 214 may be separated from the container 12. The method 300 includes step 320 of storing a second input. Step 320 includes step 322 of applying a second downward force F to the outer cap 18, 218 that causes the outer cap 18, 218 to move downwardly toward the inner cap 20, 220. Step 320 also includes step 324 of triggering the switch 28, 228 in response to the second downward force F. Step 320 also includes step 326 of applying a second rotational force to the outer cap 18, 218 so that the closure 14, 214 may be separated from the container 12. A time period elapses between the application of the first downward force F and the second downward force F. The method 300 includes step 328 of comparing the first input to the second input to determine an output. The method 300 includes step 330 of generating the indicator 68, 268 based on the output. Illustratively, the electronic system 22, 222 determines if a sufficient time period has elapsed between the application of the first downward force F and the application of the second downward force F. For example, the indicator 68, 268 of the electronic system 22, 222 is indicative of whether the package 10 has been opened too soon as compared to the prior opening of the package 10.

The container 12 includes the body 13 formed to include the product-receiving space 15, a filler neck 30, and a thread 32 as shown in FIGS. 1-4. The product-receiving space 15 is configured to receive a product therein, such as a medication. The filler neck 30 is coupled to the body 13 to extend upwardly away from the body 13. The filler neck 30 is formed to include the aperture 16 that opens into the product-receiving space 15. The closure 14 engages the filler neck 30 to selectively close the aperture 16 such that the product-receiving space 15 is not accessible to the user. The thread 32 is coupled to the filler neck 30. In some embodiments, the container 12 includes a plurality of threads 32.

The closure 14 includes the outer cap 18, the inner cap 20, and the electronic system 22 as shown in FIGS. 5 and 6. The outer cap 18 is arranged radially outward of the inner cap 20, and the electronic system 22 is arranged axially between the outer cap 18 and the inner cap 20.

The outer cap 18 includes a first top wall 34 and a first side wall 36 coupled to the first top wall 34 to extend downwardly away from the first top wall 34 as shown in FIG. 5. Illustratively, the first top wall 34 is substantially perpendicular to the vertical axis A, and the first side wall 36 is substantially parallel to the vertical axis A. The first top wall 34 defines an outer surface 34O and an inner surface 34I opposite the outer surface 34O. The downward force F is applied to the outer surface 34O of the first top wall 34.

Figure 10:
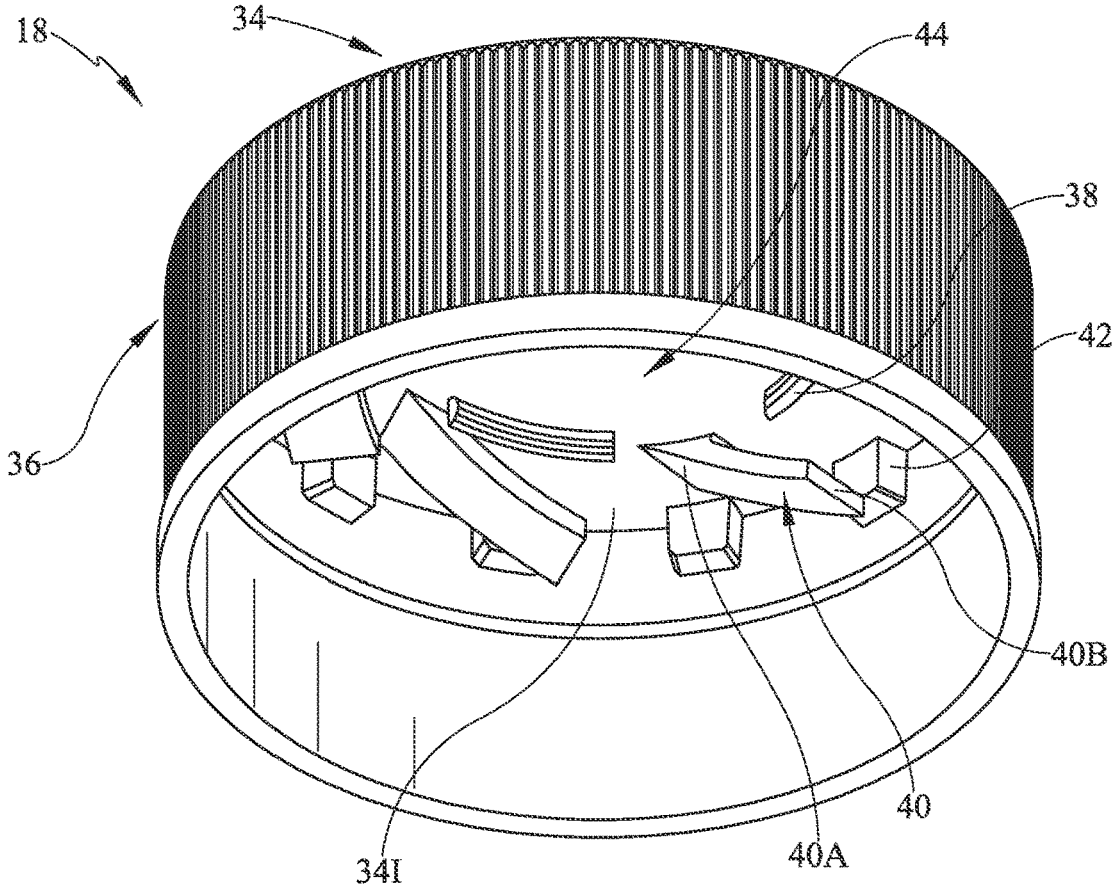
FIG. 10 is an enlarged perspective view of the outer cap showing that the outer cap is formed to include a retainer extending downwardly toward the inner cap to at least partially encircle the electronic system to maintain a position of the electronic system on the outer cap and a first protrusion arranged radially outward of the retainer and extending downwardly toward the inner cap that engages a corresponding second protrusion on the inner cap, as shown in FIG. 11, in response to the downward force so that the outer cap and the inner cap rotate together and the closure can be separated from the package.

The outer cap 18 is formed to include a retainer 38, a first protrusion 40, and a first tab 42 as shown in FIGS. 6 and 10. Each of the retainer 38, the first protrusion 40, and the first tab 42 extends downwardly from the inner surface 34I of the first top wall 34 of the outer cap 18 toward the inner cap 20. Each of the retainer 38, the first protrusion 40, and the first tab 42 is spaced apart radially from the vertical axis A. The retainer 38 is arranged radially inward of the first protrusion 40 and the first tab 42. The first protrusion 40 is arranged radially inward of the first tab 42.

Figure 12:
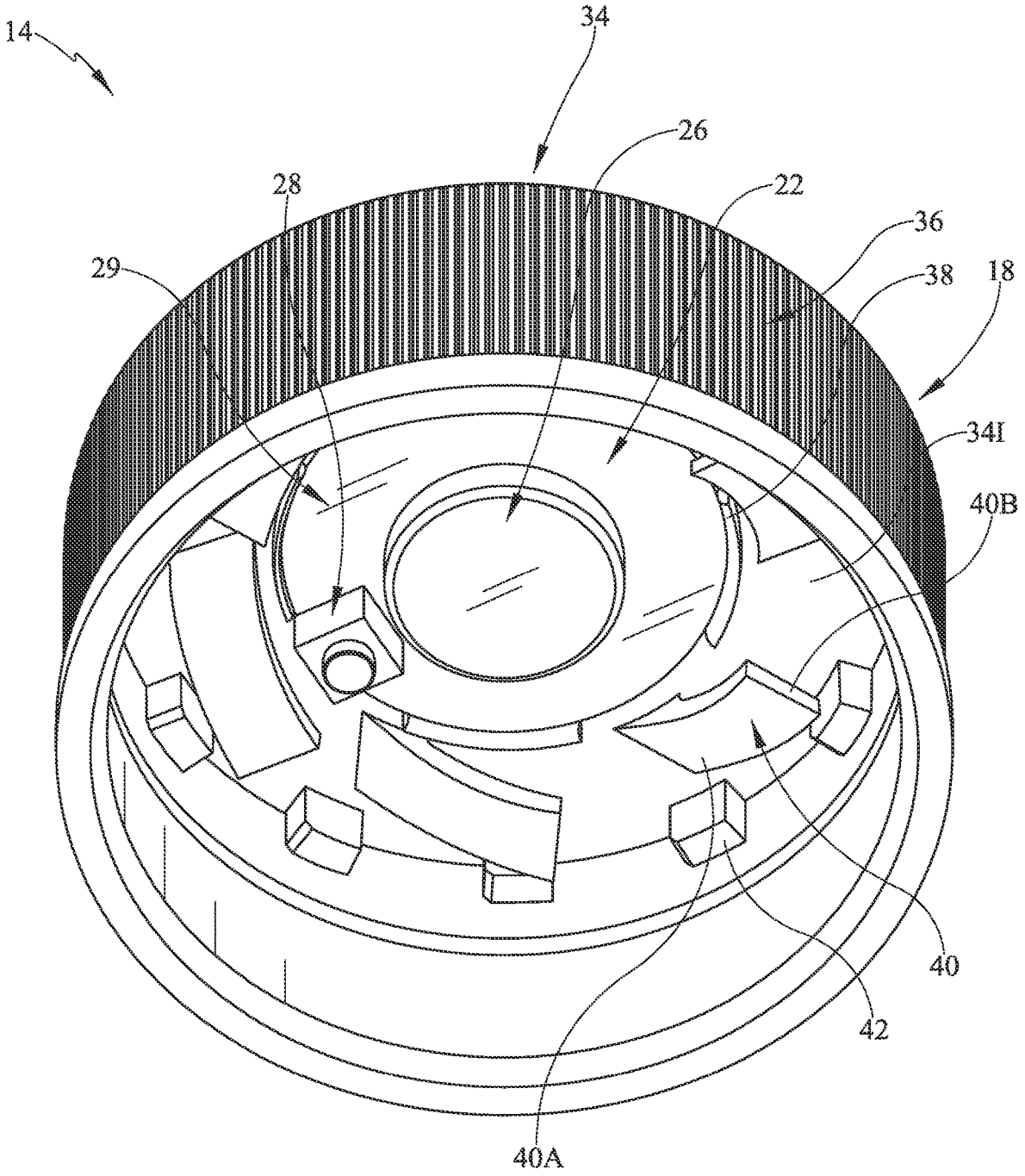
FIG. 12 is an enlarged perspective view of the outer cap with the electronic system arranged radially inward of the retainer.

The retainer 38 defines a receiving space 44 radially inward of the retainer 38 as shown in FIG. 6. The receiving space 44 receives the electronic system 22 therein as shown in FIG. 12. The retainer 38 surrounds at least a portion of the electronic system 22 to maintain a position of the electronic system 22 on the inner surface 34I of the first top wall 34 of the outer cap 18. In some embodiments, the retainer 38 extends entirely circumferentially about the vertical axis A so as to form a full ring. In some embodiments, the retainer 38 is segmented as shown in FIG. 6. As an example, the retainer 38 may include four retainer segments 38A, 38B, 38C, 38D that are each circumferentially spaced apart from one another around the vertical axis A. Each of the retainer segments 38A, 38B, 38C, 38D is curved and has a radius of curvature inside of the receiving space 44. Each of the retainer segments 38A, 38B, 38C, 38D is radially spaced apart from the vertical axis A by the same distance. The four retainer segments 38A, 38B, 38C, 38D cooperate to define the receiving space 44. Though shown with four retainer segments 38A, 38B, 38C, 38D, there may be any number of retainer segments 38 included in the outer cap 18.

The first protrusion 40 extends downwardly from the inner surface 34I of the first top wall 34 of the outer cap 18 in a circumferential direction as shown in FIGS. 6 and 10. The first protrusion 40 is fixed to the outer cap 18 such that the first protrusion 40 moves therewith in response to the downward force F. The first protrusion 40 is curved and has a radius of curvature inside of the receiving space 44. The first protrusion 40 is illustratively cantilevered and includes a first end 40A coupled with the inner surface 34I of the first top wall 34 of the outer cap 18 and a second end 40B spaced apart axially from the inner surface 34I of the first top wall 34 of the outer cap 18. The first protrusion 40 extends downwardly toward the inner cap 20 as the first protrusion 40 extends between the first end 40A and the second end 40B as shown in FIG. 10. In some embodiments, the outer cap 18 includes a plurality of first protrusions 40 that are circumferentially spaced apart from one another about the vertical axis A. For example, the outer cap 18 may include six first protrusions 40 as shown in FIG. 12, though any number is contemplated.

The first tab 42 extends downwardly from the inner surface 34I of the first top wall 34 of the outer cap 18 as shown in FIGS. 6 and 10. The first tab 42 is coupled to each of the inner surface 34I of the first top wall 34 and an inner surface 361 of the first side wall 36. The first tab 42 is fixed to the outer cap 18 such that the first tab 42 moves therewith in response to the downward force F. In some embodiments, the outer cap 18 includes a plurality of first tab 42 that are circumferentially spaced apart from one another about the vertical axis A. For example, the outer cap 18 may include twelve first tabs 42 as shown in FIG. 12, though any number is contemplated.

The inner cap 20 includes a second top wall 46 and a second side wall 48 coupled to the second top wall 46 to extend downwardly away from the second top wall 46 as shown in FIG. 5. Illustratively, the second top wall 46 is substantially perpendicular to the vertical axis A, and the second side wall 48 is substantially parallel to the vertical axis A. The second top wall 46 defines an outer surface 46O facing toward the outer cap 18 and an inner surface 46I opposite the outer surface 46O. An inner surface 48I of the second side wall 48 is formed to include a thread 50 as shown in FIG. 6. The thread 50 is configured to mate with the thread 32 of the filler neck 30 of the container 12. In some embodiments, the inner cap 20 includes a plurality of threads 50.

Figure 11:
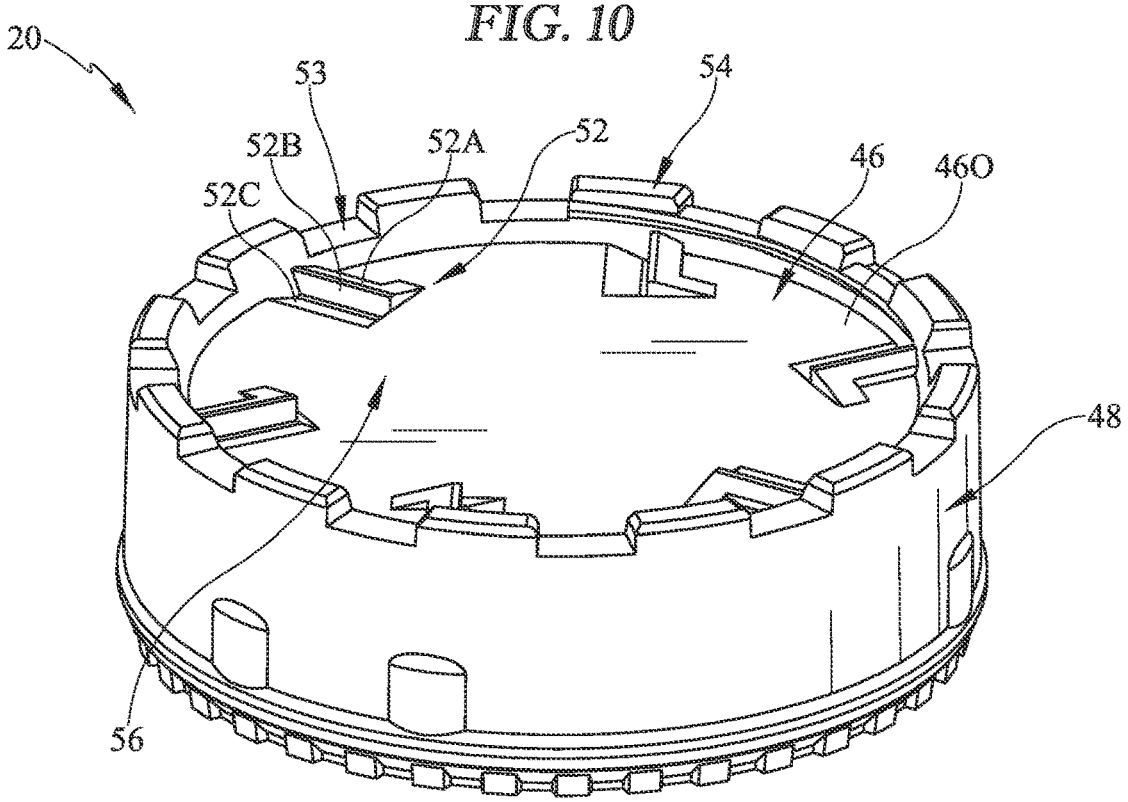
FIG. 11 is an enlarged perspective view of the inner cap showing that the inner cap is formed to include the second protrusion extending outwardly from the inner cap to engage with the first protrusion of the outer cap in response to the downward force on the outer cap.

The inner cap 20 is formed to include a second protrusion 52, a skirt 53, and a second tab 54 as shown in FIGS. 5 and 11. The second protrusion 52 engages the first protrusion 40 of the outer cap 18 in response to the downward force F applied to the outer cap 18 as shown in FIG. 9. The skirt 53 extends upwardly toward the outer cap 18 around a perimeter of the inner cap 20. The second tab 54 is arranged radially outward of the second protrusion 52 and is coupled with the skirt 53 to extend upwardly therefrom. The second tab 54 engages the first tab 42 of the outer cap 18 in response to the downward force F applied to the outer cap 18 as shown in FIG. 9.

The second protrusion 52 is formed to include a first upwardly extending portion 52A, a vertical portion 52B, and a second upwardly extending portion 52C as shown in FIGS. 5 and 11. The first upwardly extending portion 52A extends upwardly from the outer surface 46O toward the outer cap 18. Illustratively, the first upwardly extending portion 52A is L-shaped. The vertical portion 52B is coupled with and extends downwardly from the first upwardly extending portion 52A away from the outer cap 18 such that at least a portion of the vertical portion 52B is located axially below the outer surface 46O of the second top wall 46. The vertical portion 52B is substantially parallel to the vertical axis A. The second upwardly extending portion 52C is coupled with the vertical portion 52B to locate the vertical portion 42B circumferentially between the first upwardly extending portion 52A and the second upwardly extending portion 52C. The second upwardly extending portion 52C extends upwardly from the vertical portion 52B to join with the outer surface 46O of the second top wall 46. An entirety of the second upwardly extending portion 52C is located axially below the outer surface 46O of the second top wall 46.

In some embodiments, the second protrusion 52 includes a plurality of second protrusions 52 as shown in FIGS. 5 and 11. The plurality of second protrusions 52 are spaced apart circumferentially from each other about the vertical axis A. As an example, a number of the plurality of second protrusions 52 is equal to a number of the plurality of first protrusions 40 included in the outer cap 18. The plurality of second protrusions 52 are each spaced apart radially from the vertical axis A to define an electronic system receiving space 56 radially inward of the plurality of second protrusions 52. In response to the downward force F on the outer cap 18, the electronic system 22 moves downwardly with the outer cap 18 into the electronic system receiving space 56 as shown in FIG. 9.

The skirt 53 extends circumferentially about the vertical axis A as shown in FIG. 5. The skirt 53 is arranged to extend upwardly from the perimeter of the outer surface 46O of the second top wall 46 of the inner cap 20 such that the skirt 53 is axially above the outer surface 46O.

The second tab 54 extends upwardly from the skirt 53 toward the outer cap 18 as shown in FIGS. 5 and 11. In some embodiments, the inner cap 20 includes a plurality of second tabs 54 that are circumferentially spaced apart from one another about the vertical axis A. For example, the inner cap 20 may include twelve second tabs 54 as shown in FIG. 11, though any number is contemplated. Illustratively, a number of the plurality of second tabs 54 is equal to a number of the plurality of first tabs 42 of the outer cap 18.

In response to a rotational force in a first direction (i.e., counterclockwise) on the outer cap 18 without the application of the downward force F, the first protrusion 40 rotates with the outer cap 18 and the second end 40B of the first protrusion 40 ramps up the first upwardly extending portion 52A of the second protrusion 52 as the outer cap 18 rotates. The first tab 42 of the outer cap 18 is free to move over the second tab 54 of the inner cap 20 as shown in FIG. 8. For example, an inner surface 42I of the first tab 42 abuts an outer surface 54O of the second tab 54 as shown in FIG. 8.

In response to a rotational force in a second direction (i.e., clockwise) on the outer cap 18, the second end 40B of the first protrusion 40 ramps down the second upwardly extending portion 52C of the second protrusion 52 as the outer cap 18 rotates and engages the vertical portion 52B. The engagement between the second end 40B of the first protrusion 40 and the vertical portion 52B of the second protrusion 52 blocks additional rotation of the outer cap 18 relative to the inner cap 20.

In response to the downward force F and the rotational force in the first direction on the outer cap 18, the second end 40B of the first protrusion 40 and the first upwardly extending portion 52A of the second protrusion 52 engage one another such that the outer cap 18 and the inner cap 20 rotate together so that the closure 14 may be separated from the container 12. The outer cap 18 moves downwardly toward the inner cap 20 to cause the first tab 42 of the outer cap 18 to move downwardly therewith to engage the skirt 53 of the inner cap 20 as shown in FIG. 9. Due to the downward force F, the first tab 42 is located between two of the second tabs 54 such that the tabs 42, 54 interlock with one another.

The electronic system 22 includes the circuit board 24, the battery 26 coupled to the circuit board 24, and the switch 28 coupled to the circuit board 24 as shown in FIGS. 6, 8, and 9. The circuit board 24 is coupled to the inner surface 34I of the first top wall 34 of the outer cap 18 as shown in FIGS. 8 and 12. The battery 26 and the switch 28 are coupled to the circuit board 24 to extend downwardly therefrom toward the outer surface 46O of the second top wall 46 of the inner cap 20. Each of the circuit board 24, the battery 26, and the switch 28 moves with the outer cap 18.

Figure 13:
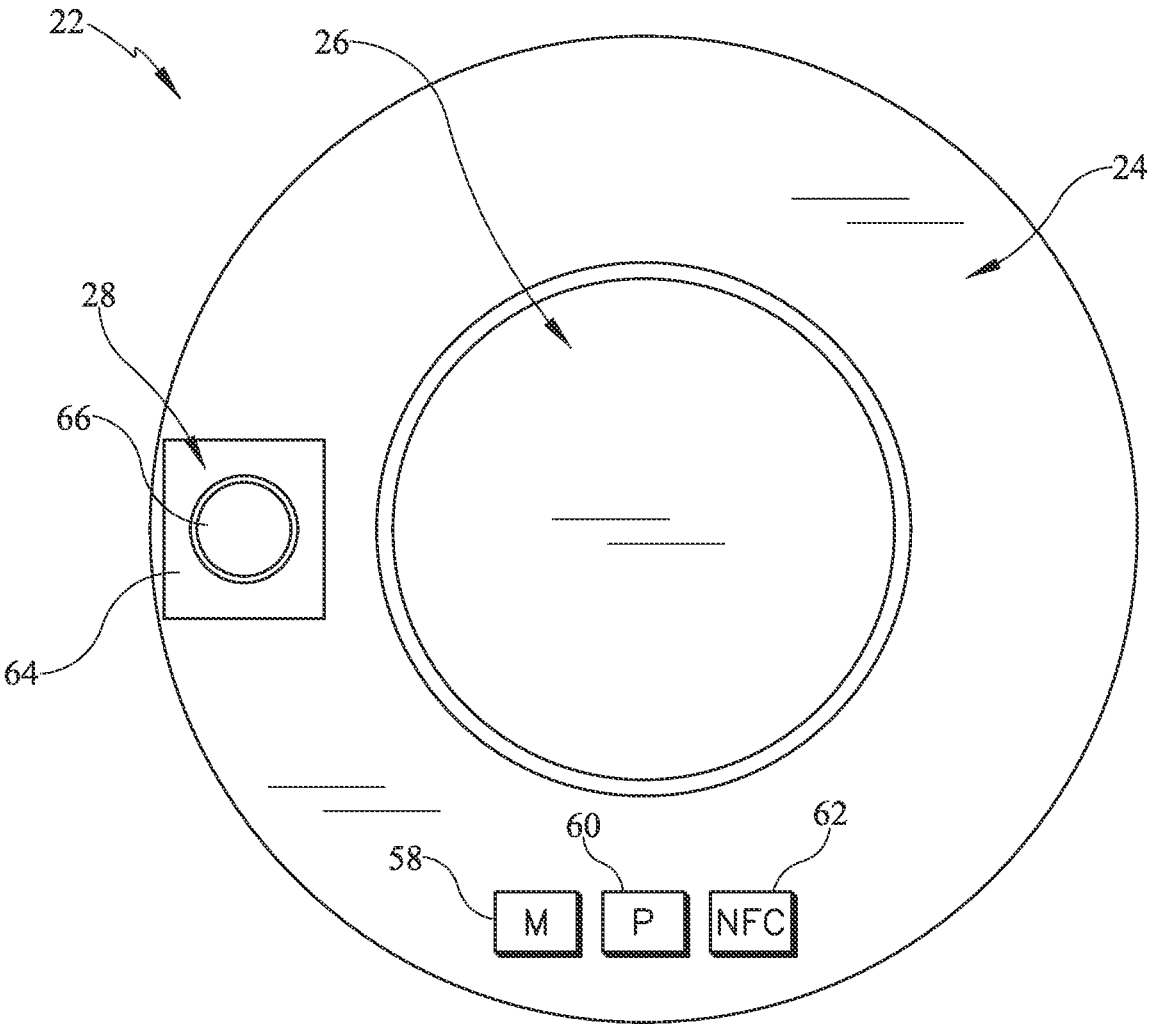
FIG. 13 is an enlarged bottom view of the electronic system showing that each of the battery and the switch are coupled to the circuit board to extend downwardly therefrom toward the inner cap.

In some embodiments, the circuit board 24 includes a memory 58, a processor 60, and a near-field communication chip 62 as shown in FIG. 13. The memory 58 logs and stores data regarding usage of the closure 14 (i.e., the first input in response to the downward force F, the second input in response to another downward force F, time data, the generated output, and/or the indicator 68). The processor 60 compares the first input and the second input to determine the output. The near-field communication chip 62 allows the data that is stored in the memory 58 to be communicated to an external electronic device. For example, if the closure 14 is placed near the external electronic device, such as a smartphone or a near-field communication reader, the recorded data is transmitted to the external electronic device. The recorded data may then be stored in an application, such as a smartphone application, on the external electronic device and transferred to a third party.

The battery 26 provides power to the circuit board 24. In some embodiments, the battery 26 may be located elsewhere relative to the circuit board 24.

The switch 28 includes a body 64 and an actuator 66 moveable relative to the body 64 as suggested in FIGS. 8 and 9. The body 64 of the switch 28 is coupled to the circuit board 24. The actuator 66 is illustratively formed as a button that is configured to be pressed inwardly into the body 64 to trigger the switch 28.

The switch 28 is configured to move with the outer cap 18 in response to the downward force F applied to the outer cap 18 as shown in FIGS. 8 and 9. Without the application of the downward force F, the switch 28 is in the first position as shown in FIG. 8. In the first position, the switch 28 is spaced apart from the outer surface 46O of the second top wall 46 of the inner cap 20. In response to the downward force F, the switch 28 moves downwardly toward the inner cap 20 to the second position as shown in FIG. 9. In the second position, the actuator 66 presses against the outer surface 46O of the second top wall 46 of the inner cap 20 to trigger the switch 28.

In use, the package 10 changes between the closed configuration in which the closure 14 is coupled to the container 12 in the locked arrangement to close the aperture 16 of the container 12, as shown in FIG. 1, and the opened configuration in which the closure 14 is changed to the unlocked arrangement and separated from the container 12 in response to the downward force F and the rotational force on the outer cap 18, as shown in FIG. 3. The downward force F on the outer cap 18 causes the switch 28 of the electronic system 22 to be activated as shown in FIG. 2. The downward force F on the outer cap 18 moves the switch 28 from the first position, in which the switch 28 is spaced apart from the outer surface 46O of the second top wall 46 of the inner cap 20, as shown in FIG. 8, to the second position, in which the switch 28 directly contacts the outer surface 46O of the second top wall 46 of the inner cap 20, as shown in FIG. 9.

After the closure 14 is separated from the container 12 and the package 10 is in the opened configuration, as shown in FIG. 4, the switch 28 is no longer activated or in the second position. Instead, the switch 28 is in the first position. The application of the downward force F to the outer cap 18, without separation of the closure 14 from the container 12 (i.e., without the package 10 changing from the closed configuration to the opened configuration), moves the switch 28 from the first positon to the second positon as shown in FIG. 2.

When the closure 14 is in the locked arrangement, as shown in FIG. 8, the first top wall 34 of the outer cap 18 is spaced apart from the second top wall 46 of the inner cap 20 a first distance. In response to the downward force F and the rotational force, the closure 14 is changed to the unlocked arrangement. In the unlocked arrangement, the first top wall 34 of the outer cap 18 is spaced apart from the second top wall 46 of the inner cap 20 a second distance that is less than the first distance as shown in FIG. 9.

In some embodiments, to achieve the engagement between the first protrusion 40 of the outer cap 18 and the second protrusion 52 of the inner cap 20 and/or the first tab 42 of the outer cap 18 and the second tab 54 of the inner cap 20, the outer cap 18 moves downwardly toward the inner cap 20 by a distance of about 1.0 mm to about 1.5 mm. In some embodiments, to achieve the engagement between the first protrusion 40 and the second protrusion 52 and/or the first tab 42 and the second tab 54, the outer cap 18 moves downwardly toward the inner cap 20 by a distance of about 1.0 mm to about 2.0 mm. In some embodiments, to achieve the engagement between the first protrusion 40 and the second protrusion 52 and/or the first tab 42 and the second tab 54, the outer cap 18 moves downwardly toward the inner cap 20 by a distance of about 1.3 mm. These distances of movement of the outer cap 18 provide sufficient space between the outer cap 18 and the inner cap 20 to allow for placement of the electronic system 22 therebetween and the triggering of the actuator 66 of the switch 28, while also providing for movement of the closure 14 between the locked arrangement and the unlocked arrangement. For example, if the distance of movement of the outer cap 18 is not large enough, then there is not sufficient space for the electronic system 22 to fit between the outer cap 18 and the inner cap 20. As another example, if the distance of movement of the outer cap 18 is not large enough, then there is not sufficient space for the actuator 66 to be pressed inwardly into the body 64 of the switch 28 for activation of the switch 28. The drawings are drawn to scale.

Figure 14:
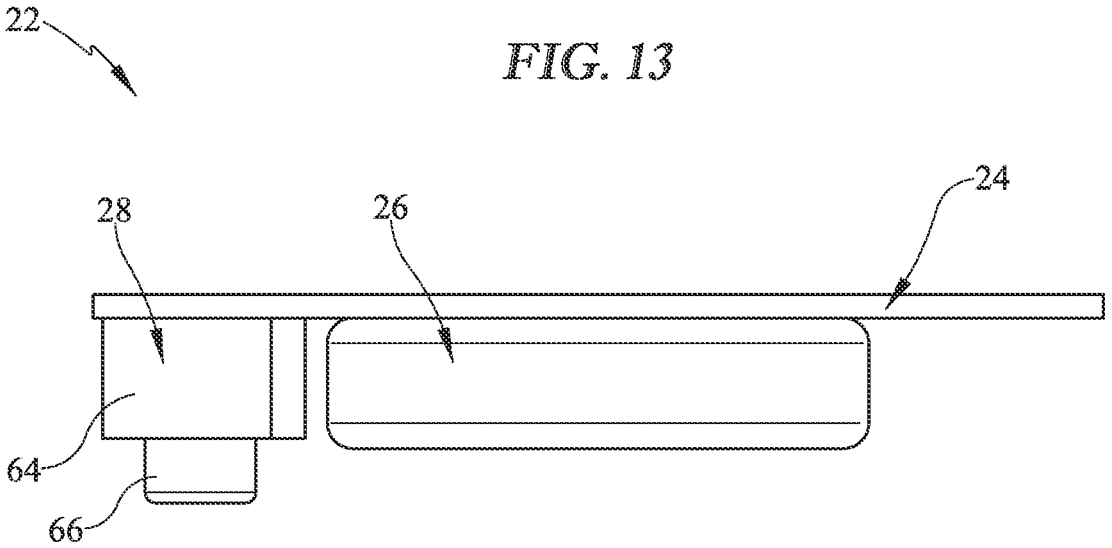
FIG. 14 is a side view of the electronic system showing that the switch extends downwardly from the circuit board a larger distance than the battery so that the switch contacts the inner cap in response to the downward force applied to the outer cap.

The battery 26 extends downwardly from the circuit board 24 a first distance as shown in FIG. 14. The switch 28 extends downwardly from the circuit board 24 a second distance that is greater than the first distance. The differing distances that the switch 28 and the battery 26 extend downwardly from the circuit board 24 ensure that the switch 28 directly contacts the inner cap 20 in response to the downward force F, instead of the battery 26 contacting the inner cap 20.

The electronic system receiving space 56 of the inner cap 20 is sized to receive the electronic system 22 therein in response to the downward force F as shown in FIG. 9. The electronic system receiving space 56 is free of protrusions so that the electronic system 22, and specifically the switch 28, is not blocked from moving downwardly toward the inner cap 20 to engage the inner cap 20.

The electronic system 22 tracks when the user separates the closure 14 from the container 12. For example, when the user applies the downward force F to the outer cap 18, the actuator 66 of the switch 28 presses into the inner cap 20 as shown in FIG. 9. When the actuator 66 of the switch 28 is pressed into the inner cap 20, the memory 58 of the circuit board 24 stores the date and the time of the application of the downward force F (i.e., the first input). When the actuator 66 of the switch 28 is pressed into the inner cap 20 again in response to a subsequent application of the downward force F, the memory 58 of the circuit board 24 stores the date and the time of the subsequent application of the downward force F (i.e., the second input). The processor 60 may compare the first input and the second input to determine an output. For example, the processor 60 may determine that the second input is too close in time to the first input, such that any medication contained in the container 12 should not be removed yet. As another example, the processor 60 may determine that the second input is appropriately spaced apart from the first input relative to time, such that any medication contained in the container 12 should be removed. An ambient air temperature may be periodically recorded at predetermined intervals and stored by the memory 58.

The electronic system 22 further includes the indicator 68 as shown in FIGS. 1-4. The electronic system 22 is configured to generate the indicator 68 based on the output as determined by the processor 60. For example, the electronic system 22 may generate the indicator 68 in response to the switch 28 being in the second position. The indicator 68 may signify whether separating the closure 14 from the container 12 is too early or appropriately timed. The indicator 68 may comprise an LED and/or a speaker. In some embodiments, the indicator 68 is a visual indicator. For example, the visual indicator may include a color, a symbol, or a word. The visual indicator may be visible from the outer surface 34O of the first top wall 34 of the outer cap 18. As an example, the visual indicator may include a red light if separation of the closure 14 from the container 12 is too early and/or a green light if separation of the closure 14 from the container 12 is appropriately timed. In some embodiments, the indicator 68 is an auditory indicator. For example, the auditory indicator may include different sounds.

In some embodiments, the electronic system 22 generates the indicator 68 without the application of the downward force F. For example, the processor 60 may compare the first input to an expected second input, which includes the expected date and time of the subsequent application of the downward force F. If the subsequent application of the downward force F is not applied to the outer cap 18 when expected, the electronic system 22 may generate the indicator 68 signifying that the closure 14 should be separated from the container 12.

In some embodiments, the indicator 68 is an electrical signal. For example, the indicator 68 is an electrical signal communicated to the external electronic device by the near-field communication chip 62. The external electronic device may include a user interface that displays a visual indicator based on the electrical signal.

The indicator 68 signifies a triggering event. The triggering event may include events such as the closure 14 was separated from the container 12 too early (e.g., before medication included in the container 12 is to be taken by the user), the closure 14 was separated from the container 12 at the appropriate time (e.g., at the time medication included in the container 12 is to be taken by the user), or that the closure 14 needs to be separated from the container 12 (e.g., that it is time for the user to take medication included in the container 12 but the user has not attempted to separate the closure 14 from the container 12).

Figure 15:
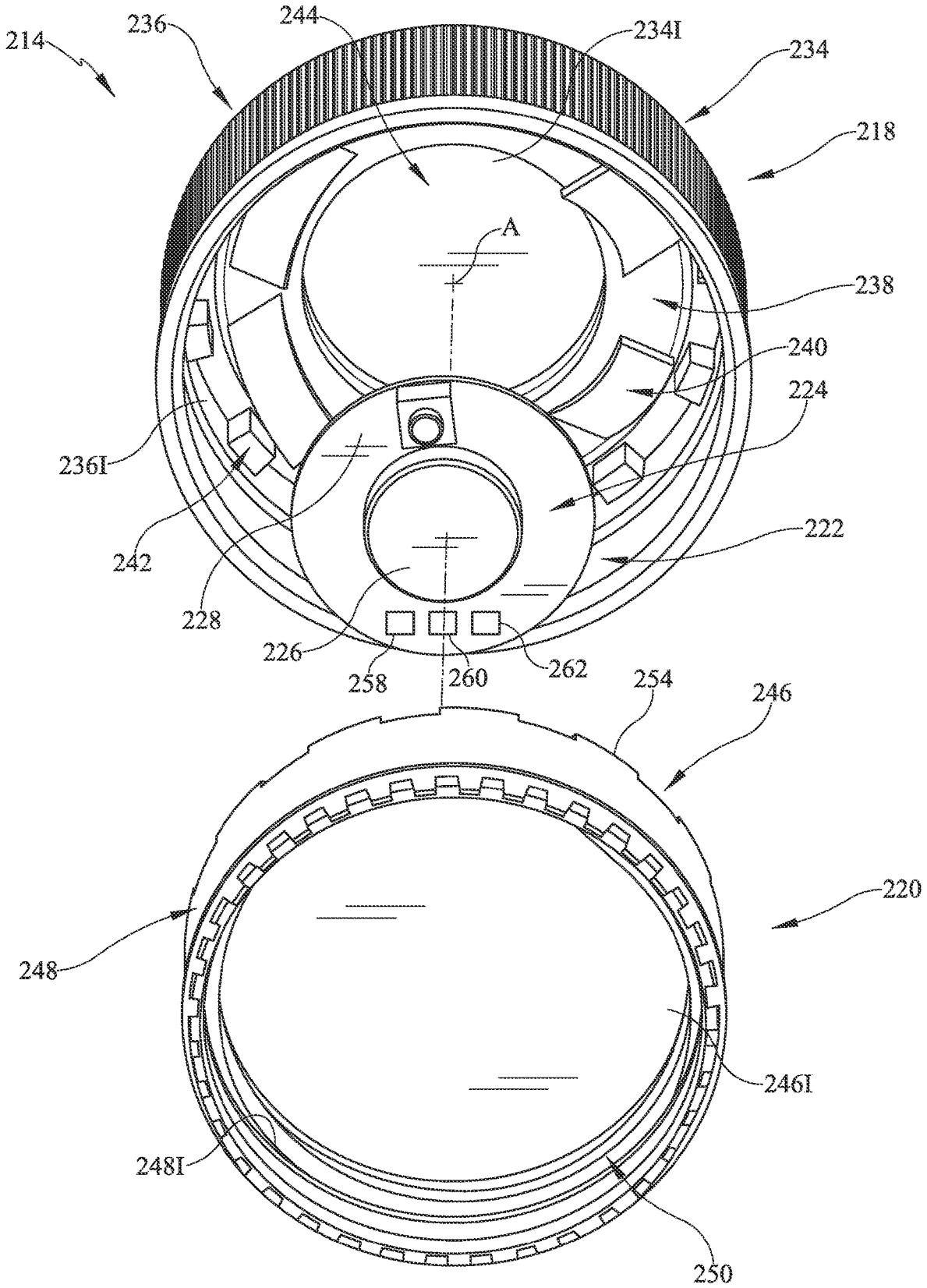
FIG. 15 is a bottom exploded assembly view of an alternative embodiment of a closure for use with the container, the closure includes an outer cap, an inner cap, and an electronic system, and further showing that the outer cap is formed to include a retainer that extends downwardly from the outer cap to define an receiving space radially inward of the retainer and a first protrusion coupled with the retainer and extending downwardly therefrom toward the inner cap.
Figure 16:
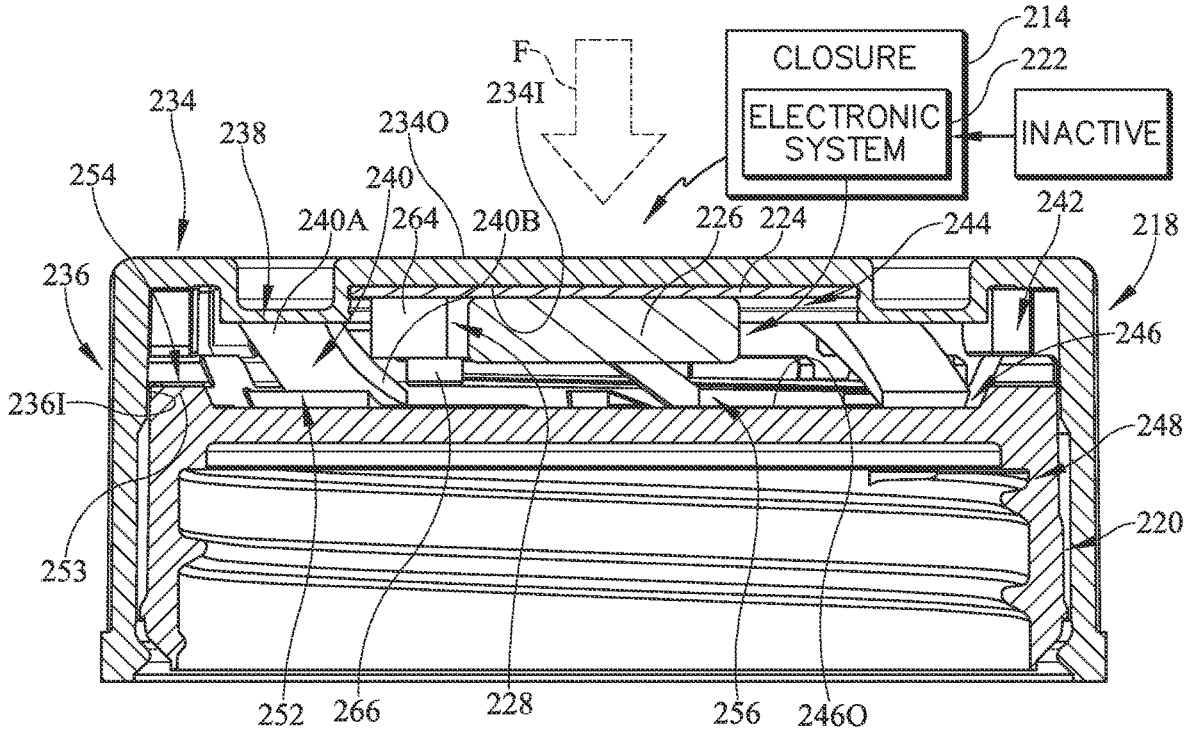
FIG. 16 is a sectional view of the closure of FIG. 15 showing the closure without the downward force applied to the outer cap so that the electronic system is inactive, and further showing that the switch is in a first position and spaced apart from the inner cap.
Figure 17:
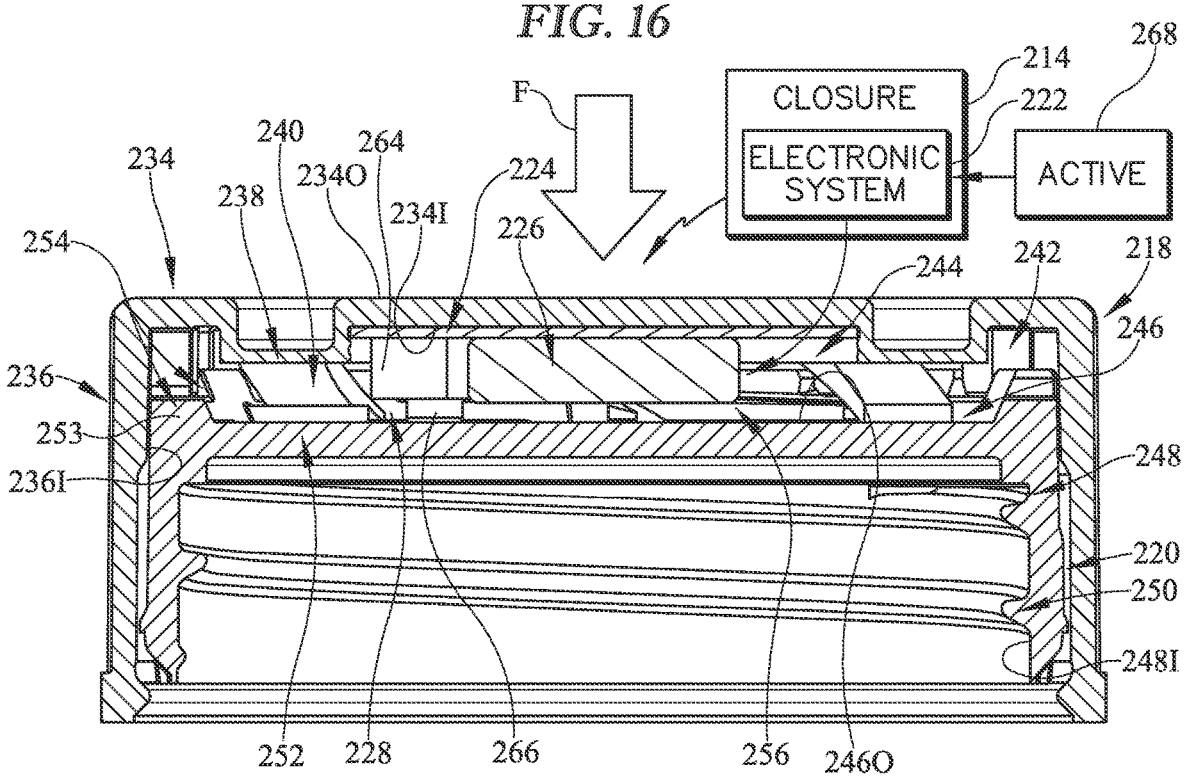
FIG. 17 is a sectional view of the closure of FIG. 15 showing the closure with the downward force applied to the outer cap that causes the outer cap to move downwardly toward the inner cap such that the electronic system is active, and further showing that, in response to the downward force, the switch moves to a second position in which the switch directly contacts the inner cap to activate the electronic system.

A second embodiment of a closure 214 in accordance with the present disclosure is shown in FIGS. 15-18. The closure 214 includes an outer cap 218, an inner cap 220, and an electronic system 222 as shown in FIGS. 15-17. The inner cap 220 is arranged radially inward of the outer cap 218 relative to a vertical axis A of the closure 214. The electronic system 222 is coupled to the outer cap 218 such that the electronic system 222 is arranged axially between the outer cap 218 and the inner cap 220 relative to the vertical axis A.

The outer cap 218 includes a first top wall 234 and a first side wall 236 coupled to the first top wall 234 to extend downwardly away from the first top wall 234. Illustratively, the first top wall 234 is substantially perpendicular to the vertical axis A, and the first side wall 236 is substantially parallel to the vertical axis A. The first top wall 234 defines an outer surface 234O and an inner surface 234I opposite the outer surface 234O. The downward force F is applied to the outer surface 234O of the first top wall 234.

Figure 18:
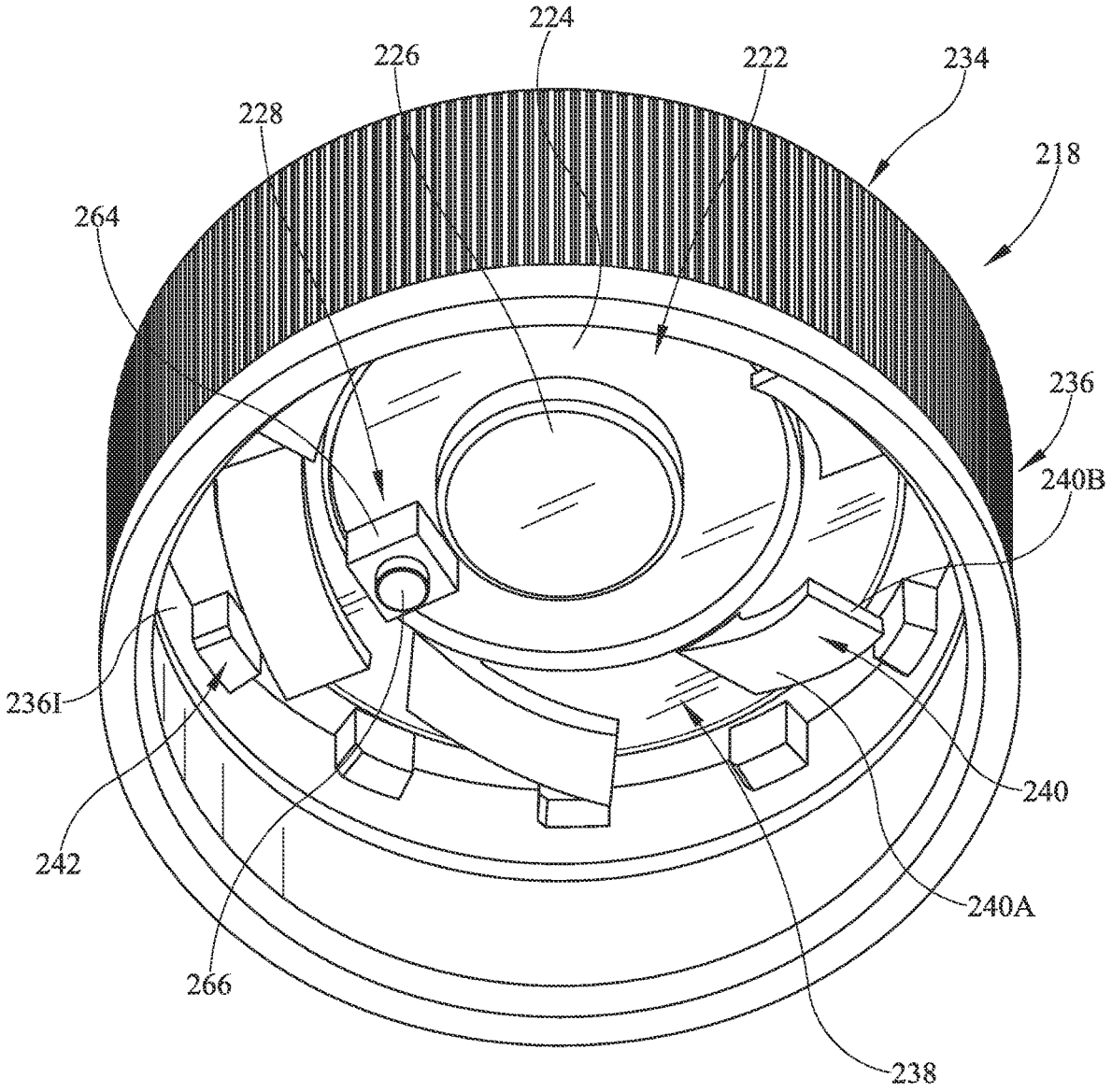
FIG. 18 is an enlarged perspective view of the outer cap and the electronic system of FIG. 15 showing that the outer cap is formed to include the first protrusion that extends downwardly from the retainer and a first tab spaced radially outward from the first protrusion and extending downwardly from the outer cap, and further showing that the electronic system is received in the receiving space.

The outer cap 218 is formed to include a retainer 238, a first protrusion 240, and a first tab 242 as shown in FIGS. 15 and 18. Each of the retainer 238 and the first tab 242 extends downwardly from the inner surface 234I of the first top wall 234 of the outer cap 218 toward the inner cap 220. Each of the retainer 238, the first protrusion 240, and the first tab 242 is spaced apart radially from the vertical axis A. The retainer 238 and the first protrusion 240 are arranged radially inward of the first tab 242. The first protrusion 240 and the retainer 238 are radially aligned with one another.

The retainer 238 defines a receiving space 244 radially inward of the retainer 238 as shown in FIG. 15. The receiving space 244 receives the electronic system 222 therein as shown in FIG. 18. The retainer 238 surrounds an entirety of the electronic system 222 to maintain a position of the electronic system 222 on the inner surface 234I of the first top wall 234 of the outer cap 218. The retainer 238 extends entirely circumferentially about the vertical axis A so as to form a full ring.

The first protrusion 240 extends downwardly from the retainer 238 in a circumferential direction toward the inner cap 220 as shown in FIGS. 15 and 18. The first protrusion 240 is curved and has a radius of curvature inside of the receiving space 244. The first protrusion 240 is illustratively cantilevered and includes a first end 240A coupled with the retainer 238 and a second end 240B spaced apart axially from the retainer 238. The first protrusion 240 extends downwardly toward the inner cap 220 as the first protrusion 240 extends between the first end 240A and the second end 240B as shown in FIG. 16. In some embodiments, the outer cap 218 includes a plurality of first protrusions 240 that are circumferentially spaced apart from one another about the vertical axis A. For example, the outer cap 218 may include six first protrusions 240 as shown in FIG. 18, though any number is contemplated.

The first tab 242 extends downwardly from the inner surface 234I of the first top wall 234 of the outer cap 218 as shown in FIGS. 15 and 18. The first tab 242 is coupled to each of the inner surface 234I of the first top wall 234 and an inner surface 2361 of the first side wall 236. The first tab 242 is fixed to the outer cap 218 such that the first tab 242 moves therewith in response to the downward force F. In some embodiments, the outer cap 218 includes a plurality of first tab 242 that are circumferentially spaced apart from one another about the vertical axis A. For example, the outer cap 218 may include twelve first tabs 242, though any number is contemplated.

The inner cap 220 includes a second top wall 246 and a second side wall 248 coupled to the second top wall 246 to extend downwardly away from the second top wall 246 as shown in FIGS. 16 and 17. The inner cap 220 is identical to the inner cap 20 previously described. Illustratively, the second top wall 246 is substantially perpendicular to the vertical axis A, and the second side wall 248 is substantially parallel to the vertical axis A. The second top wall 246 defines an outer surface 246O facing toward the outer cap 218 and an inner surface 246I opposite the outer surface 246O. An inner surface 248I of the second side wall 248 is formed to include a thread 250 as shown in FIG. 15. The thread 250 is configured to mate with the thread 32 of the filler neck 30 of the container 12. In some embodiments, the inner cap 220 includes a plurality of threads 250.

The inner cap 220 is formed to include a second protrusion 252, a skirt 253, and a second tab 254 as shown in FIGS. 16 and 17. The second protrusion 252 engages the first protrusion 240 of the outer cap 218 in response to the downward force F applied to the outer cap 218 as shown in FIG. 17. The skirt 253 extends upwardly toward the outer cap 218 around a perimeter of the inner cap 220. The second tab 254 is arranged radially outward of the second protrusion 252 and is coupled with the skirt 253 to extend upwardly therefrom. The second tab 254 engages the first tab 242 of the outer cap 218 in response to the downward force F applied to the outer cap 218 as shown in FIG. 17.

In response to rotational movement of the outer cap 218 without application of the downward force F, the first tab 242 is free to move over the second tab 254 as shown in FIG. 16. In response to the downward force F, the outer cap 218 moves downwardly toward the inner cap 220 such that the first tab 242 of the outer cap 218 moves downwardly to engage the skirt 253 of the inner cap 220 as shown in FIG. 17. The first tab 242 is located between two of the second tabs 254 such that the tabs 242, 254 interlock with one another. In response to the downward force F and the rotational force, the outer cap 218 and the inner cap 220 rotate with one another.

The electronic system 222 includes the circuit board 224, the battery 226 coupled to the circuit board 224, and the switch 228 coupled to the circuit board 224 as shown in FIGS. 15 and 18. The electronic system 222 is identical to the electronic system 22 previously described. The circuit board 224 is coupled to the inner surface 234I of the first top wall 234 of the outer cap 218 as shown in FIGS. 16, 17, and 18. The battery 226 and the switch 228 are coupled to the circuit board 224 to extend downwardly therefrom toward the outer surface 246O of the second top wall 246 of the inner cap 220. Each of the circuit board 224, the battery 226, and the switch 228 moves with the outer cap 218.

In some embodiments, the circuit board 224 includes a memory 258, a processor 260, and a near-field communication chip 262 as shown in FIG. 15. The memory 258 logs and stores data regarding usage of the closure 214 (i.e., the first input in response to the downward force F, the second input in response to another downward force F, time data, the generated output, and/or the indicator 268). The processor 260 compares the first input and the second input to determine the output. The near-field communication chip 262 allows the data that is stored in the memory 258 to be communicated to an external electronic device. For example, if the closure 214 is placed near the external electronic device, such as a smartphone or a near-field communication reader, the recorded data is transmitted to the external electronic device. The recorded data may then be stored in an application, such as a smartphone application, on the external electronic device and transferred to a third party.

The battery 226 provides power to the circuit board 224. In some embodiments, the battery 226 may be located elsewhere relative to the circuit board 224.

The switch 228 includes a body 264 and an actuator 266 moveable relative to the body 264 as suggested in FIGS. 16 and 17. The body 264 of the switch 228 is coupled to the circuit board 224. The actuator 266 is illustratively formed as a button that is configured to be pressed inwardly into the body 264 to trigger the switch 228.

The switch 228 is configured to move with the outer cap 218 in response to the downward force F applied to the outer cap 218 as shown in FIGS. 16 and 17. Without the application of the downward force F, the switch 228 is in the first position as shown in FIG. 16. In the first position, the switch 228 is spaced apart from the outer surface 246O of the second top wall 246 of the inner cap 220. In response to the downward force F, the switch 228 moves downwardly toward the inner cap 220 to the second position as shown in FIG. 17. In the second position, the actuator 266 presses against the outer surface 246O of the second top wall 246 of the inner cap 220 to trigger the switch 228.

In use, the package 10 changes between the closed configuration, in which the closure 214 is coupled to the container 12 in the locked arrangement to close the aperture 16 of the container 12, and an opened configuration, in which the closure 214 is changed to an unlocked arrangement and separated from the container 12 in response to a downward force F and a rotational force on the outer cap 218. The downward force F on the outer cap 218 causes the switch 228 of the electronic system 222 to be activated as shown in FIG. 17. The downward force F on the outer cap 218 causes the switch 228 to move from the first position, in which the switch 228 is spaced apart from the outer surface 246O of the second top wall 246 of the inner cap 220, as shown in FIG. 16, to the second position, in which the switch 228 directly contacts the outer surface 246O of the second top wall 246 of the inner cap 220, as shown in FIG. 17.

After the closure 214 is separated from the container 12 and the package is in the opened configuration, the switch 228 is no longer activated or in the second position. Instead, the switch 228 is in the first position. The application of the downward force F, without separation of the closure 214 from the container 12 (i.e., without the package 10 changing from the closed configuration to the opened configuration), moves the switch 228 from the first positon to the second positon as shown in FIG. 17.

When the closure 214 is in the locked arrangement, as shown in FIG. 16, the first top wall 234 of the outer cap 218 is spaced apart from the second top wall 246 of the inner cap 220 a first distance. In response to the downward force F and the rotational force, the closure 214 is changed to the unlocked arrangement. In the unlocked arrangement, the first top wall 234 of the outer cap 218 is spaced apart from the second top wall 246 of the inner cap 220 a second distance that is less than the first distance as shown in FIG. 17.

The battery 226 extends downwardly from the circuit board 224 a first distance as shown in FIG. 16. The switch 228 extends downwardly from the circuit board 224 a second distance that is greater than the first distance. The differing distances that the switch 228 and the battery 226 extend downwardly from the circuit board 224 ensure that the switch 228 directly contacts the inner cap 220 in response to the downward force F, instead of the battery 226 contacting the inner cap 220.

The electronic system receiving space 256 of the inner cap 220 is sized to receive the electronic system 222 therein in response to the downward force F as shown in FIG. 17. The electronic system receiving space 256 is free of protrusions so that the electronic system 222, and specifically the switch 228, is not blocked from moving downwardly toward the inner cap 220 to engage the inner cap 220.

The electronic system 222 tracks when the user separates the closure 214 from the container 12. For example, when the user applies the downward force F to the outer cap 218, the actuator 266 of the switch 228 presses into the inner cap 220. When the actuator 266 of the switch 228 is pressed into the inner cap 220, the memory 258 of the circuit board 224 stores the date and the time of the application of the downward force F (i.e., the first input). When the actuator 266 of the switch 228 is pressed into the inner cap 220 again in response to a subsequent application of the downward force F, the memory 258 of the circuit board 224 stores the date and the time of the subsequent application of the downward force F (i.e., the second input). The processor 260 may compare the first input and the second input to determine an output. For example, the processor 260 may determine that the second input is too close in time to the first input, such that any medication contained in the container 12 should not be removed yet. As another example, the processor 260 may determine that the second input is appropriately spaced apart from the first input relative to time, such that any medication contained in the container 12 should be removed. An ambient air temperature may be periodically recorded at predetermined intervals and stored by the memory 258.

The electronic system 222 further includes an indicator 268 as shown in FIGS. 16 and 17. The electronic system 222 is configured to generate the indicator 268 based on the output as determined by the processor 260. For example, the electronic system 222 may generate the indicator 268 in response to the switch 228 being in the second position. The indicator 268 may signify whether separating the closure 214 from the container 12 is too early or appropriately timed. The indicator 268 may comprise an LED and/or a speaker. In some embodiments, the indicator 268 is a visual indicator. For example, the visual indicator may include a color, a symbol, or a word. The visual indicator may be visible from the outer surface 234O of the first top wall 234 of the outer cap 218. As an example, the visual indicator may include a red light if separation of the closure 214 from the container 12 is too early and/or a green light if separation of the closure 214 from the container 12 is appropriately timed. In some embodiments, the indicator 268 is an auditory indicator. For example, the auditory indicator may include different sounds.

In some embodiments, the electronic system 222 generates the indicator 268 without the application of the downward force F. For example, the processor 260 may compare the first input to an expected second input, which includes the expected date and time of the subsequent application of the downward force F. If the subsequent application of the downward force F is not applied to the outer cap 218 when expected, the electronic system 222 may generate the indicator 268 signifying that the closure 214 should be separated from the container 12.

In some embodiments, the indicator 268 is an electrical signal. For example, the indicator 268 is an electrical signal communicated to the external electronic device by the near-field communication chip 262. The external electronic device may include a user interface that displays a visual indicator based on the electrical signal.

The indicator 268 may signify a triggering event. The triggering event may include events such as the closure 214 was separated from the container 12 too early (e.g., before medication included in the container 12 is to be taken by the user), the closure 214 was separated from the container 12 at the appropriate time (e.g., at the time medication included in the container 12 is to be taken by the user), or that the closure 214 needs to be separated from the container 12 (e.g., that it is time for the user to take medication included in the container 12 but the user has not attempted to separate the closure 214 from the container 12).

The following numbered clauses include embodiments that are contemplated and non-limiting:

Clause 1. A package comprising a container.

Clause 2. The package of clause 1, any other suitable clause, or any combination of suitable clauses, wherein the container includes a body formed to include a product-receiving space.

Clause 3. The package of clause 2, any other suitable clause, or any combination of suitable clauses, wherein the container includes a filler neck coupled to the body to extend upwardly away from the body.

Clause 4. The package of clause 3, any other suitable clause, or any combination of suitable clauses, wherein the container includes a thread coupled to the filler neck.

Clause 5. The package of clause 4, any other suitable clause, or any combination of suitable clauses, wherein the filler neck is formed to include an aperture arranged to open into the product-receiving space.

Clause 6. The package of clause 5, any other suitable clause, or any combination of suitable clauses, further comprising a closure configured to close selectively the aperture of the container.

Clause 7. The package of clause 6, any other suitable clause, or any combination of suitable clauses, wherein the closure includes an outer cap having a first top wall and a first side wall coupled to the first top wall to extend downwardly away from the first top wall.

Clause 8. The package of clause 7, any other suitable clause, or any combination of suitable clauses, wherein the closure includes an inner cap arranged radially inward of the outer cap relative to a vertical axis of the closure.

Clause 9. The package of clause 8, any other suitable clause, or any combination of suitable clauses, wherein the inner cap includes a second top wall and a second side wall coupled to the second top wall and formed to include a thread configured to mate with the thread of the filler neck.

Clause 10. The package of clause 9, any other suitable clause, or any combination of suitable clauses, further comprising an electronic system arranged axially between the first top wall of the outer cap and the second top wall of the inner cap relative to the vertical axis and coupled to an inner surface of the first top wall of the outer cap.

Clause 11. The package of clause 10, any other suitable clause, or any combination of suitable clauses, wherein the electronic system includes a battery.

Clause 12. The package of clause 11, any other suitable clause, or any combination of suitable clauses, wherein the electronic system includes a switch arranged to extend downwardly away from the first top wall toward the second top wall of the inner cap.

Clause 13. The package of clause 12, any other suitable clause, or any combination of suitable clauses, wherein the package is configured to change between a closed configuration in which the closure is coupled to the container in a locked arrangement to close the aperture of the container and an opened configuration in which the closure is changed to an unlocked arrangement and separated from the container in response to a downward force and a rotational force on the outer cap.

Clause 14. The package of clause 13, any other suitable clause, or any combination of suitable clauses, wherein the downward force on the outer cap causes the switch of the electronic system to move from a first position in which the switch is spaced apart from an outer surface of the second top wall of the inner cap to a second position in which the switch directly contacts the outer surface of the second top wall of the inner cap.

Clause 15. The package of clause 14, any other suitable clause, or any combination of suitable clauses, wherein the electronic system is configured to output an indicator in response to the switch being in the second position.

Clause 16. The package of clause 15, any other suitable clause, or any combination of suitable clauses, wherein the indicator is a visual indicator.

Clause 17. The package of clause 15, any other suitable clause, or any combination of suitable clauses, wherein the indicator is an auditory indicator.

Clause 18. The package of clause 14, any other suitable clause, or any combination of suitable clauses, wherein the switch is configured to move from the first position to the second position in response to the downward force on the outer cap without the package changing from the closed configuration to the opened configuration.

Clause 19. The package of clause 14, any other suitable clause, or any combination of suitable clauses, wherein the outer cap is formed to include a retainer arranged to extend downwardly from the first top wall of the outer cap toward the inner cap and spaced apart radially from the vertical axis of the closure.

Clause 20. The package of clause 19, any other suitable clause, or any combination of suitable clauses, wherein the electronic system is coupled to the inner surface of the first top wall of the outer cap radially inward of the retainer.

Clause 21. The package of clause 20, any other suitable clause, or any combination of suitable clauses, wherein the outer cap is formed to include a first protrusion extending downwardly from the first top wall toward the inner cap and located radially outward of the retainer Clause 22. The package of clause 21, any other suitable clause, or any combination of suitable clauses, wherein the inner cap is formed to include a second protrusion extending upwardly from the second top wall of the inner cap toward the outer cap.

Clause 23. The package of clause 22, any other suitable clause, or any combination of suitable clauses, wherein the first protrusion and the second protrusion engage one another in response to the downward force on the outer cap so that the outer cap and the inner cap rotate with one another in response to the rotational force on the outer cap.

Clause 24. The package of clause 20, any other suitable clause, or any combination of suitable clauses, wherein the outer cap is formed to include a first protrusion extending downwardly from the retainer toward the inner cap.

Clause 25. The package of clause 24, any other suitable clause, or any combination of suitable clauses, wherein the inner cap is formed to include a second protrusion extending upwardly from the second top wall of the inner cap toward the outer cap.

Clause 26. The package of clause 25, any other suitable clause, or any combination of suitable clauses, wherein the first protrusion and the second protrusion engage one another in response to the downward force on the outer cap so that the outer cap and the inner cap rotate with one another in response to the rotational force on the outer cap.

Clause 27. The package of clause 14, any other suitable clause, or any combination of suitable clauses, wherein the electronic system includes a circuit board coupled to the inner surface of the first top wall of the outer cap.

Clause 28. The package of clause 27, any other suitable clause, or any combination of suitable clauses, wherein the battery and the switch are each coupled with the circuit board to extend downwardly from the circuit board toward the inner cap.

Clause 29. The package of clause 28, any other suitable clause, or any combination of suitable clauses, wherein the battery has a first height, the switch has a second height, and the second height is greater than the first height so that the switch directly contacts the outer surface of the second top wall of the inner cap in response to the downward force on the outer cap.

Clause 30. The package of clause 14, any other suitable clause, or any combination of suitable clauses, wherein the switch is in the first position while the package is in the opened configuration.

Clause 31. The package of clause 14, any other suitable clause, or any combination of suitable clauses, wherein the outer cap moves downwardly toward the inner cap in response to the downward force by a distance of about 1.0 mm to about 1.5 mm.

Clause 32. A closure for a container comprising an outer cap.

Clause 33. The closure of clause 32, any other suitable clause, or any combination of suitable clauses, wherein the outer cap includes a first top wall and a first side wall coupled to the first top wall and arranged to extend downwardly away from the first top wall.

Clause 34. The closure of clause 33, any other suitable clause, or any combination of suitable clauses, further comprising an inner cap.

Clause 35. The closure of clause 34, any other suitable clause, or any combination of suitable clauses, wherein the inner cap is arranged radially inward of the outer cap relative to a vertical axis of the closure.

Clause 36. The closure of clause 35, any other suitable clause, or any combination of suitable clauses, wherein the inner cap includes a second top wall and a second side wall coupled to the second top wall and arranged to extend downwardly away from the second top wall.

Clause 37. The closure of clause 36, any other suitable clause, or any combination of suitable clauses, further comprising an electronic system.

Clause 38. The closure of clause 37, any other suitable clause, or any combination of suitable clauses, wherein the electronic system is coupled to an inner surface of the first top wall of the outer cap and arranged axially between the first top wall of the outer cap and the second top wall of the inner cap relative to the vertical axis.

Clause 39. The closure of clause 38, any other suitable clause, or any combination of suitable clauses, wherein the electronic system includes a circuit board coupled with the inner surface of the first top wall.

Clause 40. The closure of clause 39, any other suitable clause, or any combination of suitable clauses, wherein the electronic system includes a battery coupled to the circuit board.

Clause 41. The closure of clause 40, any other suitable clause, or any combination of suitable clauses, wherein the electronic system includes a switch coupled to the circuit board and extending downwardly away from the first top wall toward the second top wall of the inner cap.

Clause 42. The closure of clause 41, any other suitable clause, or any combination of suitable clauses, wherein the closure is configured to change between a locked arrangement in which the first top wall of the outer cap is spaced apart from the second top wall of the inner cap a first distance and an unlocked arrangement in which the first top wall of the outer cap is spaced apart from the second top wall of the inner cap a second distance that is less than the first distance in response to a downward force on the outer cap to cause the switch of the electronic system to move from a first position in which the switch is spaced apart from an outer surface of the second top wall of the inner cap to a second position in which the switch directly contacts the outer surface of the second top wall of the inner cap.

Clause 43. The closure of clause 42, any other suitable clause, or any combination of suitable clauses, wherein the electronic system is configured to output an indicator in response to the switch being in the second position.

Clause 44. The closure of clause 43, any other suitable clause, or any combination of suitable clauses, wherein the indicator is a visual indicator.

Clause 45. The closure of clause 43, any other suitable clause, or any combination of suitable clauses, wherein the indicator is an auditory indicator.

Clause 46. The closure of clause 42, any other suitable clause, or any combination of suitable clauses, wherein the outer cap is formed to include a retainer arranged to extend downwardly from the first top wall of the outer cap toward the inner cap and spaced apart radially from the vertical axis of the closure.

Clause 47. The closure of clause 46, any other suitable clause, or any combination of suitable clauses, wherein the circuit board is coupled to the inner surface of the first top wall of the outer cap radially inward of the retainer.

Clause 48. The closure of clause 47, any other suitable clause, or any combination of suitable clauses, wherein the outer cap is formed to include a first protrusion extending downwardly from the first top wall of the outer cap toward the inner cap in a circumferential direction and located radially outward of the retainer.

Clause 49. The closure of clause 48, any other suitable clause, or any combination of suitable clauses, wherein the first protrusion includes a first end coupled with the first top wall and a second end spaced apart axially from the first top wall.

Clause 50. The closure of clause 49, any other suitable clause, or any combination of suitable clauses, wherein the inner cap is formed to include a second protrusion.

Clause 51. The closure of clause 50, any other suitable clause, or any combination of suitable clauses, wherein the second protrusion includes a first portion coupled to the second top wall of the inner cap to extend upwardly away from the second top wall, a vertical portion coupled to the first portion and arranged to extend downwardly from the first portion away from the outer cap, and a second portion coupled to the vertical portion and arranged to extend between and interconnect the vertical portion and the second top wall of the inner cap.

Clause 52. The closure of clause 51, any other suitable clause, or any combination of suitable clauses, wherein the second end of the first protrusion of the outer cap engages the first portion of the second protrusion of the inner cap in response to the downward force on the outer cap so that the outer cap and the inner cap rotate with one another in response to the rotational force on the outer cap.

Clause 53. The closure of clause 47, any other suitable clause, or any combination of suitable clauses, wherein the outer cap is formed to include a first protrusion extending downwardly from the retainer of the outer cap toward the inner cap in a circumferential direction.

Clause 54. The closure of clause 53, any other suitable clause, or any combination of suitable clauses, wherein the first protrusion includes a first end coupled with the retainer and a second end spaced apart axially from the retainer.

Clause 55. The closure of clause 54, any other suitable clause, or any combination of suitable clauses, wherein the inner cap is formed to include a second protrusion.

Clause 56. The closure of clause 55, any other suitable clause, or any combination of suitable clauses, wherein the second protrusion includes a first portion coupled to the second top wall of the inner cap to extend upwardly away from the second top wall, a vertical portion coupled to the first portion and arranged to extend downwardly from the first portion away from the outer cap, and a second portion coupled to the vertical portion and arranged to extend between and interconnect the vertical portion and the second top wall of the inner cap.

Clause 57. The closure of clause 56, any other suitable clause, or any combination of suitable clauses, wherein the second end of the first protrusion of the outer cap engages the first portion of the second protrusion of the inner cap in response to the downward force on the outer cap so that the outer cap and the inner cap rotate with one another in response to the rotational force on the outer cap.

Clause 58. The closure of clause 42, any other suitable clause, or any combination of suitable clauses, wherein the outer cap moves downwardly toward the inner cap in response to the downward force by a distance of about 1.3 mm.

Clause 59. A closure for a container comprising an outer cap.

Clause 60. The closure of clause 59, any other suitable clause, or any combination of suitable clauses, wherein the outer cap includes a first top wall and a first side wall coupled to the first top wall and arranged to extend downwardly away from the first top wall.

Clause 61. The closure of clause 60, any other suitable clause, or any combination of suitable clauses, further comprising an inner cap.

Clause 62. The closure of clause 61, any other suitable clause, or any combination of suitable clauses, wherein the inner cap is arranged radially inward of the outer cap relative to a vertical axis of the closure.

Clause 63. The closure of clause 62, any other suitable clause, or any combination of suitable clauses, wherein the inner cap includes a second top wall and a second side wall coupled to the second top wall and arranged to extend downwardly away from the second top wall.

Clause 64. The closure of clause 63, any other suitable clause, or any combination of suitable clauses, wherein the closure is configured to change between a locked arrangement in which the first top wall of the outer cap is spaced apart from the second top wall of the inner cap a first distance and an unlocked arrangement in which the first top wall of the outer cap is spaced apart from the second top wall of the inner cap a second distance that is less than the first distance in response to a downward force on the outer cap to cause the outer cap to move downwardly toward the inner cap a distance of about 1.3 mm.

Clause 65. The closure of clause 64, any other suitable clause, or any combination of suitable clauses, wherein the outer cap is formed to include a retainer extending downwardly from the first top wall of the outer cap toward the inner cap and spaced apart radially from the vertical axis of the closure.

Clause 66. The closure of clause 65, any other suitable clause, or any combination of suitable clauses, wherein a receiving space is formed radially inward of the retainer.

Clause 67. The closure of clause 66, any other suitable clause, or any combination of suitable clauses, wherein the outer cap is formed to include a first protrusion extending downwardly from the first top wall toward the inner cap in a circumferential direction and located radially outward of the retainer.

Clause 68. The closure of clause 67, any other suitable clause, or any combination of suitable clauses, wherein the inner cap is formed to include a second protrusion extending upwardly from the second top wall of the inner cap toward the outer cap.

Clause 69. The closure of clause 68, any other suitable clause, or any combination of suitable clauses, wherein the first protrusion and the second protrusion engage one another in response to the downward force on the outer cap.

Clause 70. The closure of clause 66, any other suitable clause, or any combination of suitable clauses, wherein the outer cap is formed to include a first protrusion extending downwardly from the retainer toward the inner cap in a circumferential direction.

Clause 71. The closure of clause 70, any other suitable clause, or any combination of suitable clauses, wherein the inner cap is formed to include a second protrusion extending upwardly from the second top wall of the inner cap toward the outer cap.

Clause 72. The closure of clause 71, any other suitable clause, or any combination of suitable clauses, wherein the first protrusion and the second protrusion engage one another in response to the downward force on the outer cap.

Clause 73. The closure of clause 64, any other suitable clause, or any combination of suitable clauses, further comprising an electronic system.

Clause 74. The closure of clause 64, any other suitable clause, or any combination of suitable clauses, wherein the electronic system is coupled to an inner surface of the first top wall of the outer cap and arranged axially between the first top wall of the outer cap and the second top wall of the inner cap relative to the vertical axis.

Clause 75. The closure of clause 74, any other suitable clause, or any combination of suitable clauses, wherein the electronic system includes a circuit board coupled with the inner surface of the first top wall.

Clause 76. The closure of clause 75, any other suitable clause, or any combination of suitable clauses, wherein the electronic system includes a battery coupled to the circuit board.

Clause 77. The closure of clause 76, any other suitable clause, or any combination of suitable clauses, wherein the electronic system includes a switch coupled to the circuit board and extending downwardly away from the first top wall toward the second top wall of the inner cap.

Clause 78. The closure of clause 77, any other suitable clause, or any combination of suitable clauses, wherein the switch of the electronic system moves between a first position in which the switch is spaced apart from an outer surface of the second top wall of the inner cap and a second position in which the switch directly contacts the outer surface of the second top wall of the inner cap in response to the downward force on the outer cap.

Clause 79. The closure of clause 78, any other suitable clause, or any combination of suitable clauses, wherein the electronic system is configured to output an indicator in response to the switch being in the second position.

Clause 80. A method of using a package comprises providing a package.

Clause 81. The closure of clause 80, any other suitable clause, or any combination of suitable clauses, wherein the package includes a container and a closure selectively coupled with the container.

Clause 82. The closure of clause 81, any other suitable clause, or any combination of suitable clauses, wherein the closure includes an outer cap.

Clause 83. The closure of clause 82, any other suitable clause, or any combination of suitable clauses, wherein the closure includes an inner cap coupled to the outer cap.

Clause 84. The closure of clause 83, any other suitable clause, or any combination of suitable clauses, wherein the closure includes an electronic system located between the outer cap and the inner cap.

Clause 85. The closure of clause 84, any other suitable clause, or any combination of suitable clauses, further comprising storing a first input in response to a first force sensed on the outer cap of the closure by the electronic system in response to the outer cap moving toward the inner cap.

Clause 86. The closure of clause 85, any other suitable clause, or any combination of suitable clauses, further comprising storing a second input in response to a second force sensed on the outer cap of the closure by the electronic system in response to the outer cap moving toward the inner cap.

Clause 87. The closure of clause 86, any other suitable clause, or any combination of suitable clauses, further comprising comparing the first input to the second input to determine an output.

Clause 88. The closure of clause 87, any other suitable clause, or any combination of suitable clauses, further comprising generating an indicator based on the output.

Clause 89. The closure of clause 88, any other suitable clause, or any combination of suitable clauses, further comprising moving the electronic system downwardly with the outer cap toward the inner cap in response to the first force sensed on the outer cap of the closure.

Clause 90. The closure of clause 88, any other suitable clause, or any combination of suitable clauses, further comprising triggering a switch included in the electronic system in response to the first force sensed on the outer cap of the closure.

Clause 91. The closure of clause 88, any other suitable clause, or any combination of suitable clauses, wherein the output comprises a visual indicator.

Clause 92. The closure of clause 91, any other suitable clause, or any combination of suitable clauses, wherein the first force sensed on the outer cap of the closure and the second force sensed on the outer cap of the closure are spaced apart from one another by a time interval.

The invention claimed is:

1. A package comprising:

a container including a body formed to include a product-receiving space, a filler neck coupled to the body to extend upwardly away from the body, and a thread coupled to the filler neck, the filler neck formed to include an aperture arranged to open into the product-receiving space, and a closure configured to close selectively the aperture of the container, the closure including an outer cap having a first top wall and a first side wall coupled to the first top wall to extend downwardly away from the first top wall, an inner cap arranged radially inward of the outer cap relative to a vertical axis of the closure and including a second top wall and a second side wall coupled to the second top wall and formed to include a thread configured to mate with the thread of the filler neck, and an electronic system arranged axially between the first top wall of the outer cap and the second top wall of the inner cap relative to the vertical axis and coupled to an inner surface of the first top wall of the outer cap, the electronic system including a battery and a switch arranged to extend downwardly away from the first top wall toward the second top wall of the inner cap, wherein the package is configured to change between a closed configuration in which the closure is coupled to the container in a locked arrangement to close the aperture of the container and an opened configuration in which the closure is changed to an unlocked arrangement and separated from the container in response to a downward force and a rotational force on the outer cap, the downward force on the outer cap causes the switch of the electronic system to move from a first position in which the switch is spaced apart from an outer surface of the second top wall of the inner cap to a second position in which the switch directly contacts the outer surface of the second top wall of the inner cap, wherein the outer cap is formed to include a retainer arranged to extend downwardly from the first top wall of the outer cap toward the inner cap and spaced apart radially from the vertical axis of the closure, and wherein the electronic system is coupled to the inner surface of the first top wall of the outer cap radially inward of the retainer, wherein the outer cap is formed to include a first protrusion extending downwardly from the first top wall toward the inner cap and located radially outward of the retainer, and wherein the inner cap is formed to include a second protrusion extending upwardly from the second top wall of the inner cap toward the outer cap, the first protrusion and the second protrusion engage one another in response to the downward force on the outer cap so that the outer cap and the inner cap rotate with one another in response to the rotational force on the outer cap.

2. The package of claim 1, wherein the electronic system is configured to output an indicator in response to the switch being in the second position.

3. The package of claim 2, wherein the indicator is a visual indicator.

4. The package of claim 2, wherein the indicator is an auditory indicator.

5. The package of claim 1, wherein the switch is configured to move from the first position to the second position in response to the downward force on the outer cap without the package changing from the closed configuration to the opened configuration.

6. The package of claim 1, wherein the switch is in the first position while the package is in the opened configuration.

7. The package of claim 1, wherein the outer cap moves downwardly toward the inner cap in response to the downward force by a distance of about 1.0 mm to about 1.5 mm.

8. A package comprising:

a container including a body formed to include a product-receiving space, a filler neck coupled to the body to extend upwardly away from the body, and a thread coupled to the filler neck, the filler neck formed to include an aperture arranged to open into the product-receiving space, and a closure configured to close selectively the aperture of the container, the closure including an outer cap having a first top wall and a first side wall coupled to the first top wall to extend downwardly away from the first top wall, an inner cap arranged radially inward of the outer cap relative to a vertical axis of the closure and including a second top wall and a second side wall coupled to the second top wall and formed to include a thread configured to mate with the thread of the filler neck, and an electronic system arranged axially between the first top wall of the outer cap and the second top wall of the inner cap relative to the vertical axis and coupled to an inner surface of the first top wall of the outer cap, the electronic system including a battery and a switch arranged to extend downwardly away from the first top wall toward the second top wall of the inner cap, wherein the package is configured to change between a closed configuration in which the closure is coupled to the container in a locked arrangement to close the aperture of the container and an opened configuration in which the closure is changed to an unlocked arrangement and separated from the container in response to a downward force and a rotational force on the outer cap, the downward force on the outer cap causes the switch of the electronic system to move from a first position in which the switch is spaced apart from an outer surface of the second top wall of the inner cap to a second position in which the switch directly contacts the outer surface of the second top wall of the inner cap, wherein the outer cap is formed to include a retainer arranged to extend downwardly from the first top wall of the outer cap toward the inner cap and spaced apart radially from the vertical axis of the closure, and wherein the electronic system is coupled to the inner surface of the first top wall of the outer cap radially inward of the retainer, wherein the outer cap is formed to include a first protrusion extending downwardly from the retainer toward the inner cap, and wherein the inner cap is formed to include a second protrusion extending upwardly from the second top wall of the inner cap toward the outer cap, the first protrusion and the second protrusion engage one another in response to the downward force on the outer cap so that the outer cap and the inner cap rotate with one another in response to the rotational force on the outer cap.

9. A package comprising:

a container including a body formed to include a product-receiving space, a filler neck coupled to the body to extend upwardly away from the body, and a thread coupled to the filler neck, the filler neck formed to include an aperture arranged to open into the product-receiving space, and a closure configured to close selectively the aperture of the container, the closure including an outer cap having a first top wall and a first side wall coupled to the first top wall to extend downwardly away from the first top wall, an inner cap arranged radially inward of the outer cap relative to a vertical axis of the closure and including a second top wall and a second side wall coupled to the second top wall and formed to include a thread configured to mate with the thread of the filler neck, and an electronic system arranged axially between the first top wall of the outer cap and the second top wall of the inner cap relative to the vertical axis and coupled to an inner surface of the first top wall of the outer cap, the electronic system including a battery and a switch arranged to extend downwardly away from the first top wall toward the second top wall of the inner cap, wherein the package is configured to change between a closed configuration in which the closure is coupled to the container in a locked arrangement to close the aperture of the container and an opened configuration in which the closure is changed to an unlocked arrangement and separated from the container in response to a downward force and a rotational force on the outer cap, the downward force on the outer cap causes the switch of the electronic system to move from a first position in which the switch is spaced apart from an outer surface of the second top wall of the inner cap to a second position in which the switch directly contacts the outer surface of the second top wall of the inner cap, wherein the electronic system includes a circuit board coupled to the inner surface of the first top wall of the outer cap and the battery and the switch are each coupled with the circuit board to extend downwardly from the circuit board toward the inner cap, and wherein the battery has a first height, the switch has a second height, and the second height is greater than the first height so that the switch directly contacts the outer surface of the second top wall of the inner cap in response to the downward force on the outer cap.

10. A closure for a container, the closure comprising:

an outer cap including a first top wall and a first side wall coupled to the first top wall and arranged to extend downwardly away from the first top wall, an inner cap arranged radially inward of the outer cap relative to a vertical axis of the closure and including a second top wall and a second side wall coupled to the second top wall and arranged to extend downwardly away from the second top wall, and an electronic system coupled to an inner surface of the first top wall of the outer cap and arranged axially between the first top wall of the outer cap and the second top wall of the inner cap relative to the vertical axis, the electronic system including a circuit board coupled with the inner surface of the first top wall, a battery coupled to the circuit board, and a switch coupled to the circuit board and extending downwardly away from the first top wall toward the second top wall of the inner cap, wherein the closure is configured to change between a locked arrangement in which the first top wall of the outer cap is spaced apart from the second top wall of the inner cap a first distance and an unlocked arrangement in which the first top wall of the outer cap is spaced apart from the second top wall of the inner cap a second distance that is less than the first distance in response to a downward force on the outer cap to cause the switch of the electronic system to move from a first position in which the switch is spaced apart from an outer surface of the second top wall of the inner cap to a second position in which the switch directly contacts the outer surface of the second top wall of the inner cap, wherein the outer cap is formed to include a retainer arranged to extend downwardly from the first top wall of the outer cap toward the inner cap and spaced apart radially from the vertical axis of the closure, and wherein the circuit board is coupled to the inner surface of the first top wall of the outer cap radially inward of the retainer, wherein the outer cap is formed to include a first protrusion extending downwardly from the retainer of the outer cap toward the inner cap in a circumferential direction, the first protrusion including a first end coupled with the retainer and a second end spaced apart axially from the retainer, and wherein the inner cap is formed to include a second protrusion, the second protrusion including a first portion coupled to the second top wall of the inner cap to extend upwardly away from the second top wall, a vertical portion coupled to the first portion and arranged to extend downwardly from the first portion away from the outer cap, and a second portion coupled to the vertical portion and arranged to extend between and interconnect the vertical portion and the second top wall of the inner cap, and wherein the second end of the first protrusion of the outer cap engages the first portion of the second protrusion of the inner cap in response to the downward force on the outer cap so that the outer cap and the inner cap rotate with one another in response to the rotational force on the outer cap.

11. The closure of claim 10, wherein the outer cap moves downwardly toward the inner cap in response to the downward force by a distance of about 1.3 mm.

12. A closure for a container, the closure comprising:

an outer cap including a first top wall and a first side wall coupled to the first top wall and arranged to extend downwardly away from the first top wall, an inner cap arranged radially inward of the outer cap relative to a vertical axis of the closure and including a second top wall and a second side wall coupled to the second top wall and arranged to extend downwardly away from the second top wall, and an electronic system coupled to an inner surface of the first top wall of the outer cap and arranged axially between the first top wall of the outer cap and the second top wall of the inner cap relative to the vertical axis, the electronic system including a circuit board coupled with the inner surface of the first top wall, a battery coupled to the circuit board, and a switch coupled to the circuit board and extending downwardly away from the first top wall toward the second top wall of the inner cap, wherein the closure is configured to change between a locked arrangement in which the first top wall of the outer cap is spaced apart from the second top wall of the inner cap a first distance and an unlocked arrangement in which the first top wall of the outer cap is spaced apart from the second top wall of the inner cap a second distance that is less than the first distance in response to a downward force on the outer cap to cause the switch of the electronic system to move from a first position in which the switch is spaced apart from an outer surface of the second top wall of the inner cap to a second position in which the switch directly contacts the outer surface of the second top wall of the inner cap, wherein the outer cap is formed to include a retainer arranged to extend downwardly from the first top wall of the outer cap toward the inner cap and spaced apart radially from the vertical axis of the closure, and wherein the circuit board is coupled to the inner surface of the first top wall of the outer cap radially inward of the retainer, wherein the outer cap is formed to include a first protrusion extending downwardly from the first top wall of the outer cap toward the inner cap in a circumferential direction and located radially outward of the retainer, the first protrusion including a first end coupled with the first top wall and a second end spaced apart axially from the first top wall, and wherein the inner cap is formed to include a second protrusion, the second protrusion including a first portion coupled to the second top wall of the inner cap to extend upwardly away from the second top wall, a vertical portion coupled to the first portion and arranged to extend downwardly from the first portion away from the outer cap, and a second portion coupled to the vertical portion and arranged to extend between and interconnect the vertical portion and the second top wall of the inner cap, and wherein the second end of the first protrusion of the outer cap engages the first portion of the second protrusion of the inner cap in response to the downward force on the outer cap so that the outer cap and the inner cap rotate with one another in response to the rotational force on the outer cap.

13. A method of using a package comprising:

providing the package, the package including a container and a closure selectively coupled with the container, the closure having an outer cap, an inner cap coupled to the outer cap, and an electronic system located between the outer cap and the inner cap, storing a first input in response to a first force sensed on the outer cap of the closure by the electronic system in response to the outer cap moving toward the inner cap, storing a second input in response to a second force sensed on the outer cap of the closure by the electronic system in response to the outer cap moving toward the inner cap, comparing the first input to the second input to determine an output, and generating an indicator based on the output.

14. The method of claim 13, further comprising moving the electronic system downwardly with the outer cap toward the inner cap in response to the first force sensed on the outer cap of the closure.

15. The method of claim 13, further comprising triggering a switch included in the electronic system in response to the first force sensed on the outer cap of the closure.

16. The method of claim 13, wherein the first force sensed on the outer cap of the closure and the second force sensed on the outer cap of the closure are spaced apart from one another by a time interval.

* * * * *